US006200715B1

(12) United States Patent
Fuller et al.

(10) Patent No.: US 6,200,715 B1
(45) **Date of Patent: *Mar. 13, 2001**

(54) IMAGING MEMBERS CONTAINING ARYLENE ETHER ALCOHOL POLYMERS

(75) Inventors: Timothy J. Fuller, Pittsford; John F. Yanus, Webster; Damodar M. Pai; Markus R. Silvestri, both of Fairport; Ram S. Narang, Macedon; William W. Limburg, Penfield; Dale S. Renfer, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/363,218

(22) Filed: Jul. 29, 1999

Related U.S. Application Data

(63) Continuation-in-part of application No. 09/326,170, filed on Jun. 4, 1999.

(51) Int. Cl.[7] ..... G03G 5/05

(52) U.S. Cl. ..... 430/59.6; 430/96

(58) Field of Search ..... 430/59.6, 96, 58.7

(56) References Cited

U.S. PATENT DOCUMENTS

| | | | | |
|---|---|---|---|---|
| 5,411,827 | * | 5/1995 | Tamura et al. | 430/59.6 |
| 5,739,254 | | 4/1998 | Fuller et al. | 528/125 |
| 5,761,809 | | 6/1998 | Fuller et al. | 29/890.1 |
| 5,814,426 | | 9/1998 | Fuller et al. | 430/96 |
| 5,849,809 | | 12/1998 | Narang et al. | 522/35 |
| 5,863,963 | | 1/1999 | Narang et al. | 522/162 |
| 5,874,192 | | 2/1999 | Fuller et al. | 430/58 |
| 5,882,814 | | 3/1999 | Fuller et al. | 430/59 |
| 5,889,077 | | 3/1999 | Fuller et al. | 522/162 |

* cited by examiner

*Primary Examiner*—Christopher D. Rodee
(74) *Attorney, Agent, or Firm*—John L. Haack; Peter Kondo

(57) ABSTRACT

An electrophotographic imaging member including a support member, a charge generating layer and a charge transport layer, the charge transport layer including a cross linked matrix derived from a cross linkable aromatic polymer with substituent groups containing unsaturated carbon to carbon double bond, the substituent groups being free of any urethane linkage and attached to phenylene.

18 Claims, No Drawings

IMAGING MEMBERS CONTAINING ARYLENE ETHER ALCOHOL POLYMERS

This is a continuation-in-part application of copending application Ser. No. 09/326,170 entitled "IMAGING MEMBERS CONTAINING ARYLENE ETHER ALCOHOL POLYMERS", filed in the names of T. J. Fuller et al. on Jun. 4, 1999. The entire disclosure of this copending application is incorporated herein by reference.

BACKGROUND OF THE INVENTION

This invention relates in general to electrophotographic imaging members and, more specifically, to charge transport layers comprising a cross linked matrix derived from an aromatic polymer.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive imaging member, exposing the imaging member to a light and shadow image to dissipate the charge on the areas of the imaging member exposed to the light, and developing the resulting electrostatic latent image by depositing on the image a finely divided electroscopic material known as toner. In the Charge Area Development (CAD) scheme, the toner will normally be attracted to those areas of the imaging member which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment. Imaging members for electrophotographic imaging systems comprising selenium alloys vacuum deposited on substrates are known. Imaging members have also been prepared by coating substrates with photoconductive particles dispersed in an organic film forming binder. Coating of rigid drum substrates has been effected by various techniques such as spraying, dip coating, vacuum evaporation, and the like. Flexible imaging members can also be manufactured by processes that entail coating a flexible substrate with the desired photoconducting material.

Some photoresponsive imaging members consist of a homogeneous layer of a single material such as vitreous selenium, and others comprise composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder. Imaging members prepared according to the teachings of this patent contain a binder layer with particles of zinc oxide uniformly dispersed therein coated on a paper backing. The binders disclosed in this patent include materials such as polycarbonate resins, polyester resins, polyamide resins, and the like.

Photoreceptor materials comprising inorganic or organic materials wherein the charge generating and charge transport functions are performed by discrete contiguous layers are also known. Additionally, layered photoreceptor members are disclosed in the prior art, including photoreceptors having an overcoat layer of an electrically insulating polymeric material. Other layered photoresponsive devices have been disclosed, including those comprising separate photogenerating layers and charge transport layers as described in U.S. Pat. No. 4,265,990, the disclosure of which is totally incorporated herein by reference.

Deposition of charge on the photoreceptor surface by bias charging rolls (BCR) is usually accompanied by significant degradation of the charge transport layer. This degradation is believed to be caused by plasma generated in the contact zone between the charging roll and the photoreceptor at breakdown electric fields. More specifically, bias roll charging of organic photoreceptors, particularly under alternating current conditions with the positive portion of the wave unfiltered, leads to significant degradation of the photoreceptor surface and undesirable reduction of the transport layer thickness. This degradation limits the useful life of the photoreceptor and is one reason why the use of bias charging rolls is currently limited to low volume printers and copiers. Preliminary test results indicate that overcoating of a charge transport layer with a cross linked charge transport polymer improves the resistance of the photoreceptor surface to BCR degradation. However, the use of such overcoat would require yet another coating step which can reduce production yields. Moreover, the overcoat itself often does not adhere to a small molecule/binder polymer transport layer underneath. Further, if a cross linked charge transport polymer is used as transport layer, this material may not have sufficient carrier mobility.

INFORMATION DISCLOSURE STATEMENT

U.S. Pat. No. 5,814,426 to T. Fuller et al. issued on Sep. 29, 1998—An imaging member is disclosed which comprises a conductive substrate, a photogenerating material, and a binder which comprises a polymer of specific formulae I, II, III, IV, V, VI, VII, VIII, IX or X as further described in the patent. These polymers may be used in a charge transport layer.

U.S. Pat. No. 5,874,192 to Timothy J. Fuller et al., issued Feb. 23, 1999—Disclosed is an imaging member which comprises a conductive substrate, a photogenerating material, a charge transport material, and a polymeric binder comprising (a) a first polymer comprising a polycarbonate, and (b) a second polymer of specified formulae I, II, III, IV, V, VI, VII, VIII, IX, or X as further defined therein. These binders may be used in a charge transport layer.

U.S. Pat. No. 5,761,809 to Fuller et al., issued Jun. 9, 1998—Disclosed is a process which comprises reacting a haloalkylated aromatic polymer with a material selected from the group consisting of unsaturated ester salts, alkoxide salts, alkylcarboxylate salts, and mixtures thereof, thereby forming a curable polymer having functional groups corresponding to the selected salt. Another embodiment of the invention is directed to a process for preparing an ink jet printhead with the curable polymer thus prepared.

U.S. Pat. No. 5,889,077 to Timothy J. Fuller et al., issued Mar. 30, 1999—Disclosed is a process which comprises reacting a polymer of specific formulae as further described in the patent, with (i) a formaldehyde source, and (ii) an unsaturated acid in the presence of an acid catalyst, thereby forming a curable polymer with unsaturated ester groups. Also disclosed is a process for preparing an ink jet printhead with the above polymer.

U.S. Pat. No. 5,882,814 to Timothy J. Fuller et al., issued Mar. 16, 1999—Disclosed is an imaging member which comprises a conductive substrate, a photogenerating layer, and a charge transport layer comprising a specified polymer of the formulae I, II, III, IV, V, VI, VII, VIII, IX, or X as further defined therein.

U.S. Pat. No. 5,739,254 to Timothy J. Fuller et al., issued Apr. 14, 1998—Disclosed is a process which comprises reacting a polymer of specified general formulae with an acetyl halide and dimethoxymethane in the presence of a halogen-containing Lewis acid catalyst and methanol, thereby forming a haloalkylated polymer. In a specific embodiment, the haloalkylated polymer is then reacted further to replace at least some of the haloalkyl groups with photosensitivity-imparting groups. Also disclosed is a process for preparing a thermal ink jet printhead with the aforementioned polymer.

U.S. Pat. No. 5,849,809 to Ram S. Narang et al., issued Dec. 15, 1998—Disclosed is a composition which comprises (a) a polymer containing at least some monomer repeat units with photosensitivity-imparting substituents which enable crosslinking or chain extension of the polymer upon exposure to actinic radiation, said polymer being of specified formulae, wherein said photosensitivity-imparting substituents are hydroxyalkyl groups; (b) at least one member selected from the group consisting of photoinitiators and sensitizers; and (c) an optional solvent. Also disclosed are processes for preparing the above polymers and methods of preparing thermal ink jet printheads containing the above polymers.

U.S. Pat. No. 5,863,963 to Ram S. Narang et al., issued Jan. 26, 1999—Disclosed is a process which comprises the steps of (a) providing a polymer containing at least some monomer repeat units with halomethyl group substituents which enable crosslinking or chain extension of the polymer upon exposure to a radiation source which is electron beam radiation, x-ray radiation, or deep ultraviolet radiation, said polymer being of specified formula, and (b) causing the polymer to become crosslinked or chain extended through the photosensitivity-imparting groups. Also disclosed is a process for preparing a thermal ink jet printhead by the aforementioned curing process.

CROSS REFERENCE TO COPENDING APPLICATIONS

This application is related to the following U.S. patent applications:

U.S. patent application Ser. No. 09/326,170 "IMAGING MEMBERS CONTAINING ARYLENE ETHER ALCOHOL POLYMERS" to T. J. Fuller et al., filed Jun. 4, 1999—Disclosed is an imaging member which comprises a conductive substrate, a photogenerating material, and a binder comprising a polymer of the formula

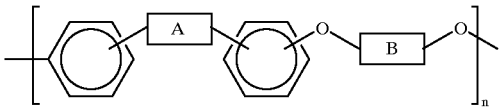

wherein A is

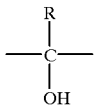

or a mixture of

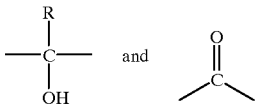

wherein R is a hydrogen atom, an alkyl group, an aryl group, or mixtures thereof, B is one of specified groups, such as

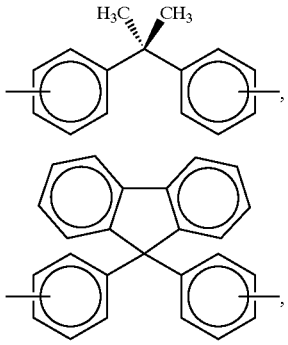

or mixtures thereof, and n is an integer representing the number of repeating monomer units.

U.S. patent application Ser. No. 08/705,375 to Thomas W. Smith et al., entitled "IMPROVED CURABLE COMPOSITIONS" filed Aug. 29, 1996. Disclosed is an improved composition comprising a photopatternable polymer containing at least some monomer repeat units with photosensitivity-imparting substituents, said photopatternable polymer being of specified general formulae. Also disclosed is a process for preparing a thermal ink jet printhead with the aforementioned polymer and a thermal ink jet printhead containing therein a layer of a crosslinked or chain extended polymer of the specified formulae.

U.S. patent application Ser. No. 08/705,488 to Thomas W. Smith et al., entitled "IMPROVED HIGH PERFORMANCE POLYMER COMPOSITIONS" filed on Aug. 29, 1996.—Disclosed is a composition comprising a polymer with a weight average molecular weight of from about 1,000 to about 100,000, said polymer containing at least some monomer repeat units with a first, photosensitivity-imparting substituent which enables crosslinking or chain extension of the polymer upon exposure to actinic radiation, said polymer also containing a second, thermal sensitivity-imparting substituent which enables further crosslinking or chain extension of the polymer upon exposure to temperatures of about 140° C. and higher, wherein the first substituent is not the same as the second substituent, said polymer being selected from the group consisting of polysulfones, polyphenylenes, polyether sulfones, polyimides, polyamide imides, polyarylene ethers, polyphenylene sulfides, polyarylene ether ketones, phenoxy resins, polycarbonates, polyether imides, polyquinoxalines, polyquinolines, polybenzimidazoles, polybenzoxazoles, polybenzothiazoles, polyoxadiazoles, copolymers thereof, and mixtures thereof.

U.S. patent application Ser. No. 08/705,376 to Ram S. Narang et al., filed Aug. 29, 1996, entitled "BLENDS CONTAINING CURABLE POLYMERS"—Disclosed is a composition which comprises a mixture of (A) a first component comprising a polymer, at least some of the monomer repeat units of which have at least one photosensitivity-imparting group thereon, said polymer having a first degree of photosensitivity-imparting group substitution measured in milliequivalents of photosensitivity-imparting group per gram and being of specified general formulae, and (B) a second component which comprises either (1) a polymer having a second degree of photosensitivity-imparting group substitution measured in milliequivalents of photosensitivity-imparting group per gram lower than the first degree of photosensitivity-imparting group substitution, wherein said second degree of photosensitivity-imparting group substitution may be zero, wherein the mixture of the first component and the second component has a third degree of photosensitivity-imparting group substitution measured in milliequivalents of photosensitivity-imparting group per gram which is lower than the first degree of photosensitivity-imparting group substitution and higher than the second degree of photosensitivity-imparting group substitution, or (2) a reactive diluent having at least one photosensitivity-imparting group per molecule and having a fourth degree of photosensitivity-imparting group substitution measured in milliequivalents of photosensitivity-imparting group per gram, wherein the mixture of the first component and the second component has a fifth degree of photosensitivity-imparting group substitution measured in milliequivalents of photosensitivity-imparting group per gram which is higher than the first degree of photosensitivity-imparting group substitution and lower than the fourth degree of photosensitivity-imparting group substitution; wherein the weight average molecular weight of the mixture is from about 10,000 to about 50,000; and wherein the third or fifth degree of photosensitivity-imparting group substitution is from about 0.25 to about 2 milliequivalents of photosensitivity-imparting groups per gram of mixture. Also disclosed is a process for preparing a thermal ink jet printhead with the aforementioned composition.

U.S. patent application Ser. No. 08/705,372 to Ram S. Narang et al., filed Aug. 29, 1996, entitled "HIGH PERFORMANCE CURABLE POLYMERS AND PROCESSES FOR THE PREPARATION THEREOF".—Disclosed is a composition which comprises a polymer containing at least some monomer repeat units with photosensitivity-imparting substituents which enable crosslinking or chain extension of the polymer upon exposure to actinic radiation, said polymer being of specified formulae, wherein said photosensitivity-imparting substituents are allyl ether groups, epoxy groups, or mixtures thereof. Also disclosed are a process for preparing a thermal ink jet printhead containing the aforementioned polymers and processes for preparing the aforementioned polymers.

U.S. patent application Ser. No. 08/697,760 to Ram S. Narang et al., filed on Aug. 29, 1996, entitled "AQUEOUS DEVELOPABLE HIGH PERFORMANCE CURABLE POLYMERS"—Disclosed is a composition which comprises a polymer containing at least some monomer repeat units with water-solubility- or water-dispersability-imparting substituents and at least some monomer repeat units with photosensitivity-imparting substituents which enable crosslinking or chain extension of the polymer upon exposure to actinic radiation, said polymer being of specified formulae. In one embodiment, a single functional group imparts both photosensitivity and water solubility or dispersability to the polymer. In another embodiment, a first functional group imparts photosensitivity to the polymer and a second functional group imparts water solubility or dispersability to the polymer. Also disclosed is a process for preparing a thermal ink jet printhead with the aforementioned polymers.

U.S. patent application Ser. No. 09/186,542 to Timothy J. Fuller et al., filed on Nov. 5, 1998, entitled "NOVEL CONDUCTING COMPOSITIONS".—Disclosed is a conductive polymer composition selected from the group consisting of a first composition including a polymer containing halomethylated aromatic groups, and a charge transporting material selected from the group consisting of at least one charge transport monomer containing arylamine groups, at least one charge transport polymer containing arylamine units in the main polymer chain, and mixtures thereof, and a second composition including at least one monomer containing a halomethylated aromatic group, at least one charge transport monomer containing arylamine groups and a polymer binder, and a third composition including: at least one monomer containing a halomethylated aromatic group, and at least one charge transport polymer with arylamine units in the main polymer chain. The aforementioned compositions may be applied as coatings and used in high speed laser printing and related printing processes. These conductive polymeric compositions and processes therefor provide improved stability and a broad range of conductivities, manufacturing and compositional latitude, and dielectric strength.

U.S. patent application Ser. No. 09/325,837 "INK JET PRINTHEADS CONTAINING ARYLENE ETHER ALCOHOL POLYMERS" to William W. Limburg et al., filed Jun. 4, 1999—Disclosed is an ink jet printhead containing a polymer of the formula

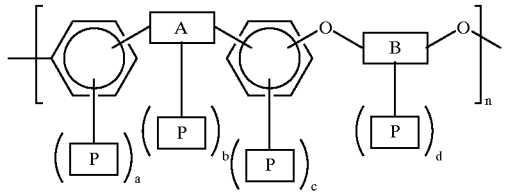

wherein P is a substituent which enables crosslinking of the polymer, a, b, c, and d are each integers of 0, 1, 2, 3, or 4, provided that at least one of a, b, c, and d is equal to or greater than 1 in at least some of the monomer repeat units of the polymer, A is

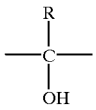

or a mixture of

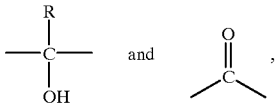

wherein R is a hydrogen atom, an alkyl group, an aryl group, or mixtures thereof, B is one of specified groups, such as

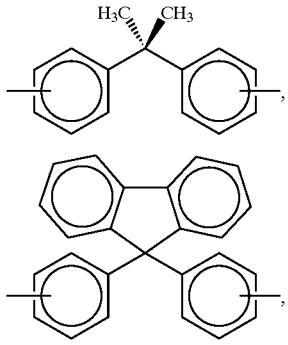

or mixtures thereof, and n is an integer representing the number of repeating monomer units.

U.S. patent application Ser. No. 09/326,170 "IMAGING MEMBERS CONTAINING ARYLENE ETHER ALCOHOL POLYMERS" to William W. Limburg et al, filed Jun. 4, 1999—Disclosed is an imaging member which comprises a conductive substrate, a photogenerating material, and a binder comprising a polymer of the formula

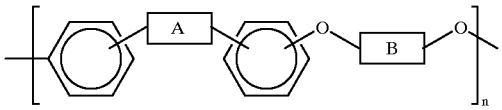

wherein A is

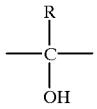

or a mixture of

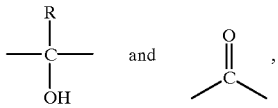

wherein R is a hydrogen atom, an alkyl group, an aryl group, or mixtures thereof, B is one of specified groups, such as

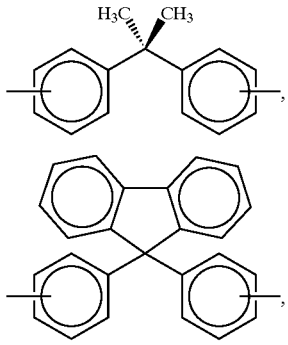

or mixtures thereof, and n is an integer representing the number of repeating monomer units.

BRIEF SUMMARY OF THE INVENTION

It is, therefore, an object of the present invention to provide an improved electrophotographic imaging member comprising a charge transport layer comprising a cross linked matrix.

It is another object of the present invention to provide an improved electrophotographic imaging member comprising a charge transport layer comprising a cross linked matrix derived from a polyarylene ether ketone.

It is still another object of the present invention to provide an improved electrophotographic imaging member comprising a charge transport layer comprising a cross linked matrix having high carrier mobilities.

It yet another object of the present invention to provide an improved electrophotographic imaging member comprising a cross linked matrix, the cross linked matrix being formed by the action of heat or light after coating from a solvent.

It is another object of the present invention to provide an improved electrophotographic imaging member comprising a charge transport layer comprising a cross linked matrix that is as tough, abrasion resistant and flexible, or better than existing charge transport layers.

It is still another object of the present invention to provide an improved electrophotographic imaging member comprising a charge transport layer comprising a cross linked matrix formed from coating solutions that are stable prior to and during formation of the charge transport layer It yet another object of the present invention to provide an improved electrophotographic imaging member comprising a cross linked polyarylene ether ketone and a hole transporting molecule.

It another object of the present invention to provide an improved electrophotographic imaging member having a solvent insoluble binder.

The foregoing objects and others are accomplished in accordance with this invention by providing an electrophotographic imaging member comprising a support member, a charge generating layer and a charge transport layer, the charge transport layer comprising a cross linked matrix derived from a cross linkable aromatic polymer with substituent groups containing unsaturated carbon to carbon double bond, the substituent groups being attached to phenylene groups by chemical bonds.

A preferred embodiment is directed to an electrophotographic imaging member comprising a support member, a charge generating layer and a charge transport layer, the charge transport layer comprising a cross linked matrix derived from a cross linkable aromatic polymer with substituent groups containing unsaturated carbon to carbon double bond, the substituent groups being free of any urethane linkage and attached to phenylene groups.

Generally, a photoconductive imaging member comprises a substrate having a conductive surface, an optional charge blocking layer, an optional adhesive layer, a photogeneration (charge generating) layer comprising a photogenerating compound optionally dispersed in a film forming binder, a charge transport layer comprising a charge transport compound molecularly dispersed or dissolved in a resinous binder, an optional anticurl backing layer, and an optional protective overcoating layer. If desired, the charge transport layer may be situated between the conductive substrate instead of the photogenerating layer being sandwiched between the conductive substrate and the charge transport layer.

The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. Similarly, the substrate can be either rigid or flexible. In a particularly preferred embodiment, the thickness of this layer is from about 3 mils to about 10 mils. For flexible belt imaging members, preferred substrate thicknesses are from about 65 to about 150 micrometers, and more preferably from about 75 to about 100 micrometers for optimum flexibility and minimum stretch when cycled around small diameter rollers of, for example, 19 millimeter diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semi-transparent aluminum, steel, cadmium, silver, gold, zirconium, niobium, tantalum, vanadium, halfnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The conductive layer can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and preferably from about 100 to about 200 Angstroms for an optimum combination of electrical conductivity, flexibility, and light transmission. When the selected substrate comprises a nonconductive base and an electrically conductive layer is coated thereon, the substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as Mylar (available from Du Pont) or Melinex 447 (available from ICI Americas, Inc.), and the like. The conductive layer can be coated onto the base layer by any suitable coating technique, such as vacuum deposition or the like. If desired, the substrate can comprise a metallized plastic, such as titanized or aluminized Mylar, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate may comprise a metal oxide such as aluminum oxide, nickel oxide, titanium oxide, or the like.

The photoconductive imaging member may optionally contain a charge blocking layer situated between the conductive substrate and the photogenerating layer. Generally, electron blocking layers for positively charged photoreceptors allow holes from the imaging surface of the photoreceptor to migrate toward the conductive layer, while hole blocking layers for negatively charged photoreceptors allow electrons from the imaging surface of the photoreceptor to migrate toward the conductive layer. This layer may comprise metal oxides, such as aluminum oxide and the like, or materials such as silanes and nylons, nitrogen containing siloxanes or nitrogen containing titanium compounds, such as, trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. No. 4,291,110, U.S. Pat. No. 4,338,387, U.S. Pat. No. 4,286,033 and U.S. Pat. No. 4,291,110, U.S. Pat. No. 4,464,450, the entire disclosures of each being incorporated herein by reference, or the like. Undercoat layers of gamma-amino-propyl triethoxy silane, tributoxy zirconium acetylacetonate, and polyvinylbutyral have been used on organic photoreceptor metal drums as taught in U.S. Pat. No. 5,449,573. Other metal complex undercoat layers are described in U.S. Pat. No. 4,444,862 and U.S. Pat. No. 4,555,621. Additional examples of typical materials include gelatin (e.g. Gelatin 225, available from Knox Gelatine Inc.), and/or Carboset 515 (B. F. Goodrich Chemical Company) dissolved in water and methanol, polyvinyl alcohol, polyamides, gamma-aminopropyl triethoxysilane, polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures or blends thereof, copolymers thereof, and the like. A preferred blocking layer comprises a reaction product between a hydrolyzed silane and the oxidized surface of a metal ground plane layer. The oxidized surface inherently forms on the outer surface of most metal ground plane layers when exposed to air after deposition. The primary purpose of this layer is to prevent charge injection from the substrate during and after charging. This layer is typically of a thickness of less than 50 Angstroms to about 10 micrometers, preferably being no more than about 2 micrometers, and more preferably being no more than about 0.2 micrometers, although the thickness can be outside this range.

The blocking layer may be applied by any suitable conventional technique such as spraying, dip coating, draw bar coating, gravure coating, silk screening, air knife coating, reverse roll coating, slot coating, vacuum deposition, chemical treatment or the like. For convenience in obtaining thin layers, the blocking layers are preferably applied in the form of a dilute solution, with the solvent being removed after deposition of the coating by conventional techniques such as by vacuum, heating and the like.

In some cases, intermediate adhesive layers between the substrate and subsequently applied layers may be desirable to improve adhesion. If such adhesive layers are utilized, they preferably have a dry thickness of from about 0.1 micrometer to about 5 micrometers, although the thickness can be outside of this range. Typical adhesive layers include film-forming polymers such as polyesters, polyvinylbutyrals, polyvinylpyrrolidones, polycarbonates, polyurethanes, polymethylmethacrylates, duPont 49,000 (available from E. I. duPont de Nemours and Company), Vitel PE100 (available from Goodyear Tire & Rubber), and the like as well as mixtures thereof. Since the surface of the substrate can include a charge blocking layer or an adhesive layer, the expression "substrate" as employed herein is intended to include a charge blocking layer with or without an adhesive layer on a charge blocking layer. Typical adhesive layer thicknesses are from about 0.05 micrometer to about 0.3 micrometer, although the thickness can be outside this range. Conventional techniques for applying an adhesive layer coating mixture to the substrate include spraying, dip coating, roll coating, wire wound rod coating, gravure coating, Bird bar applicator coating, slot coating, or the like. Drying of the deposited coating may be effected by any suitable conventional technique, such as oven drying, infra red radiation drying, air drying, or the like. The photogenerating layer may comprise single or multiple layers comprising inorganic or organic compositions and the like. One example of a generator layer is described in U.S. Pat. No. 3,121,006, the entire disclosure of which is incorporated herein by reference, wherein finely divided particles of a photoconductive inorganic compound are dispersed in an electrically insulating organic resin binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference.

The photogenerating or photoconductive layer contains any desired or suitable photoconductive material. The photoconductive layer or layers may contain inorganic or organic photoconductive materials. Typical inorganic photoconductive materials include amorphous selenium, trigonal selenium, alloys of selenium with elements such as tellurium, arsenic, and the like, amorphous silicon, cadmium sulfoselenide, cadmium selenide, cadmium sulfide, zinc oxide, titanium dioxide and the like. Inorganic photoconductive materials can, if desired, be dispersed in a film forming polymer binder.

Typical organic photoconductors include various phthalocyanine pigments, such as the X-form of metal free phthalocyanine described in U.S. Pat. No. 3,357,989, the entire disclosure of which is incorporated herein by reference, metal phthalocyanines such as vanadyl phthalocyanine, copper phthalocyanine, and the like, quinacridones, including those available from DuPont as Monastral Red, Monastral Violet and Monastral Red Y, substituted 2,4-diamino-triazines as disclosed in U.S. Pat. No. 3,442,781, the entire disclosure of which is incorporated herein by reference, polynuclear aromatic quinones, Indofast Violet Lake B, Indofast Brilliant Scarlet, Indofast Orange, dibromoanthanthrones such as those available from DuPont as Vat orange 1 and Vat orange 3, squarylium, pyrazolones, polyvinylcarbazole-2,4,7-trinitrofluorenone, anthracene, benzimidazole perylene, polynuclear aromatic quinones available from Allied Chemical Corporation under the tradename Indofast Double Scarlet, Indofast Violet Lake B, Indofast Brilliant Scarlet and Indofast Orange, and the like. Many organic photoconductor materials may also be used as particles dispersed in a resin binder.

Examples of typical binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly (N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The particle size of the photoconductive compositions and/or pigments preferably is less than the thickness of the deposited solidified layer, and more preferably is between about 0.01 micrometer and about 0.5 micrometer to facilitate better coating uniformity.

The photogenerating layer containing photoconductive compositions and the resinous binder material generally ranges in thickness from about 0.05 micrometer to about 10 micrometers or more, preferably being from about 0.1 micrometer to about 5 micrometers, and more preferably having a thickness of from about 0.3 micrometer to about 3 micrometers, although the thickness can be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, slot coating, and the like. Drying of the deposited coating may be effected by any suitable technique, such as oven drying, infra red radiation drying, air drying and the like.

Any other suitable multilayer photoconductors may also be employed in the imaging member of this invention. Some multilayer photoconductors comprise at least two electrically operative layers, a photogenerating or charge generating layer and a charge transport layer. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference.

The charge transport layer comprising a cross linked matrix derived from a cross linkable aromatic polymer with substituent groups containing unsaturated carbon to carbon double bond, the substituent groups being attached to phenylene groups. Preferably, the substituent groups being free of any urethane linkage.

A preferred cross linkable aromatic polymer with substituent groups containing unsaturated carbon to carbon double bond, the substituent groups being attached to phenylene groups, comprises units represented by formulae selected from the group consisting of

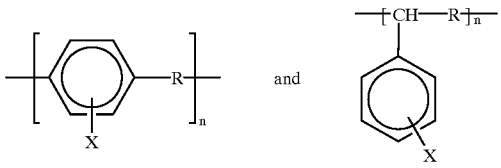

wherein n is an integer representing the number of repeating monomer units,

R is a divalent group, and

X is a substituent group containing an unsaturated carbon to carbon double bond.

In a preferred embodiment, X is a substituent group free of any urethane linkage and containing an unsaturated carbon to carbon double bond.

Any suitable divalent group may be used for R. Typical divalent groups include, for example, alkylene, cycloaliphatic alkylene group, arylene, substituted alkylene, substituted arylene, sulfonyl, carbonate, carbonyl, oxygen, sulfur, and the like. Any suitable substituent group containing an unsaturated carbon to carbon double bond may be used for X. Preferably, X is a substituent group free of any urethane linkage and contains an unsaturated carbon to carbon double bond. Typical substituent groups containing an unsaturated carbon to carbon double bond include, for example, vinyl, vinyloxy-methyl, acryloxymethyl, methacryloxymethyl, cinnamoyloxy-methyl, vinylphenoxymethyl, allylphenoxymethyl, and the like. The expression "urethane linkage" as employed herein is defined as linkage containing —NHC(O)O—. Especially preferred examples of cross linkable aromatic polymers with substituent groups containing unsaturated carbon to carbon double bond attached to phenylene groups include, for example, acidoxymethylated -polyarylene ether ketones, -polystyrenes, -polycarbonates, polyarylene ether sulfones, -acrylated polycarbonates, -acrylated polystyrenes, -vinyl substituted polyarylene ether ketones, vinyl-substituted polystyrenes, acidamido-methylated-polyarylene ether ketone, -polystyrenes, -polysulfones, and -polycarbonates, and the like. Typical representative structures include

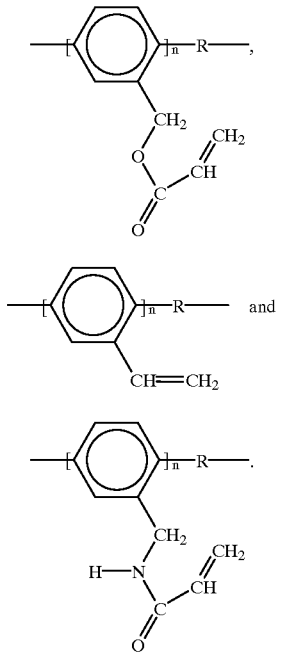

Upon cross-linking, the cross-linkable polymers of this invention form a three-dimensional network matrix in which charge transporting small molecules are molecularly dispersed or dissolved. The matrix polymer should be fully compatible with the small molecule selected in both the uncross linked and the cross linked states to ensure uniform dissolving or molecular dispersion.

The cross linked matrix of the charge transport layer of this invention are derived from a cross linkable polymer comprising segments functionalized with polymerizable groups free of any urethane linkage. Generic structures representative of preferred polyarylene ether ketones, polyarylene ether sulfones, polystyrenes, and polycarbonates, especially those based on bisphenol A, include those selected from the group consisting of

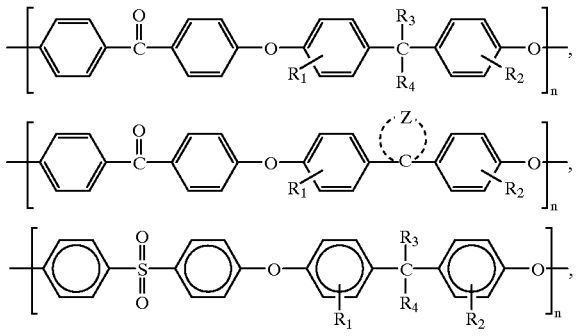

-continued

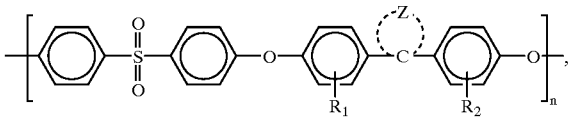

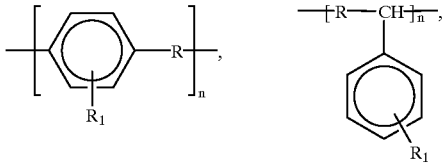

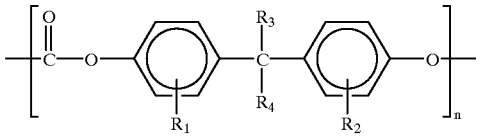

and

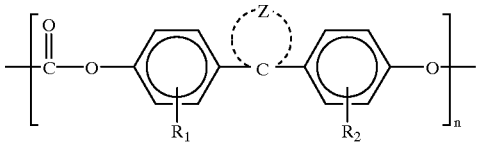

wherein each of:

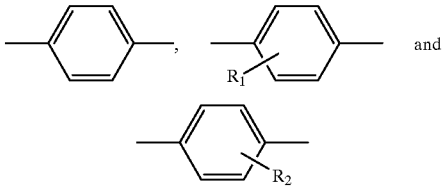

in the above formulae is independently substituted or unsubstituted other than with $R_1$ and $R_2$, n is an integer representing the number of repeating monomer units, $R_1$ and $R_2$ are independently selected from the group comprising —H and —$CH_2$—$R_5$, wherein at least one of $R_1$ and $R_2$ is —$CH_2$—$R_5$, $R_3$ and $R_4$ are independently selected from the group comprising H, substituted organic groups, and unsubstituted organic groups, the organic groups containing from 1 to 20 carbon atoms, $R_5$ is a radical free of any urethane linkage and derived from a monobasic or polybasic organic acid containing a reactive unsaturated carbon to carbon double bond, Z is a group of atoms necessary to constitute a cycloaliphatic or heterocyclic ring containing from 3 to 20 carbon atoms, and any suitable divalent group can be used for R.

The polymers contain one or more phenylene groups, e.g., the phenylene groups:

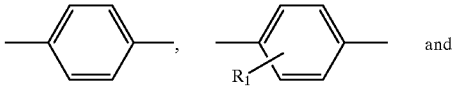

-continued

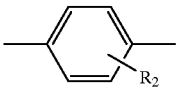

The hydrogen atoms attached to the carbon atoms of these phenylene groups at locations other than that occupied by $R_1$ and $R_2$, may be substituted, although the presence of two or more substituents on the phenylene group ortho to the oxygen groups can render substitution difficult for polymers containing a benzophenone group connected through an oxygen atom to a group derived from a bisphenol. Substituents can be present on the phenylene groups of the polymer either prior to or subsequent to the placement of polymerizable functional groups onto the polymer. The expression "polymerizable functional groups" as employed herein is defined as a reactive alkenyl or olefinic group (i.e., containing at least one unsaturated carbon to carbon double bond) capable of addition reaction. Substituents can also be placed on the phenylene groups during the process of placement of the polymerizable functional groups onto the polymer. Examples of typical substituents include, but are not limited to, alkyl groups, including saturated, unsaturated, and cyclic alkyl groups, preferably with from 1 to about 6 carbon atoms, substituted alkyl groups, including saturated, unsaturated, and cyclic substituted alkyl groups, preferably with from 1 to about 6 carbon atoms, aryl groups, preferably with from 6 to about 24 carbon atoms, substituted aryl groups, preferably with from 6 to about 24 carbon atoms, arylalkyl groups, preferably with from 7 to about 30 carbon atoms, substituted arylalkyl groups, preferably with from 7 to about 30 carbon atoms, alkoxy groups, preferably with from 1 to about 6 carbon atoms, substituted alkoxy groups, preferably with from 1 to about 6 carbon atoms, aryloxy groups, preferably with from 6 to about 24 carbon atoms, substituted aryloxy groups, preferably with from 6 to about 24 carbon atoms, arylalkyloxy groups, preferably with from 7 to about 30 carbon atoms, substituted arylalkyloxy groups, preferably with from 7 to about 30 carbon atoms, and amino groups. Other typical substituents include, for example, imine groups, ammonium groups, pyridine groups, pyridinium groups, ether groups, ester groups, amide groups, carbonyl groups, thiocarbonyl groups, sulfate groups, sulfonate groups, sulfide groups, sulfoxide groups, phosphine groups, phosphonium groups, phosphate groups, mercapto groups, nitroso groups, sulfone groups, acyl groups, acid anhydride groups, azide groups, and the like. The substituents on the substituted alkyl groups, substituted aryl groups, substituted arylalkyl groups, substituted alkoxy groups, substituted aryloxy groups, and substituted arylalkyloxy groups can include, but are not limited to, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, mixtures thereof, and the like, wherein two or more substituents can be joined together to form a ring. All of these substituents are preferably free of any urethane linkage.

$R_3$ and $R_4$ are attached to the methylene carbon atom of the bisphenol derivative moiety of the cross linkable polymer. $R_3$ and $R_4$ are monovalent groups and, may for example, be independently selected from the group comprising H, $CH_3$, $CF_3$, ethyl, phenyl, substituted aliphatic, cycloaliphatic, allyl, cyclohexylene, fluorenenyl, and the like containing up to 30 carbon atoms.

Any suitable radical, preferably free of any urethane linkage, and derived from a monobasic or polybasic organic acid containing a reactive double bond may be used for $R_5$. Typical examples of $R_5$ include:

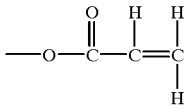

derived from acrylic acid,

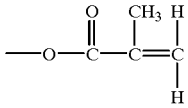

derived from methacrylic acid,

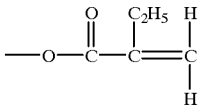

derived from ethacrylic acid,

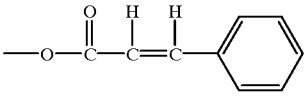

derived from cinnamic acid,

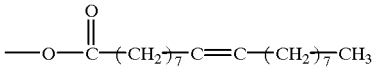

derived from oleic acid,

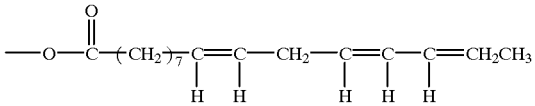

derived from linoleic acid,

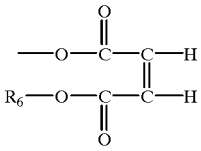

derived from maleic acid,

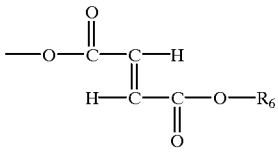

derived from fumaric acid,

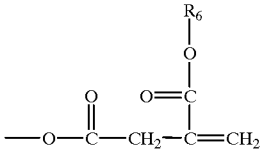

derived from itaconic acid,

-continued

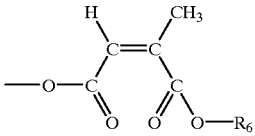

derived from citranoic acid,

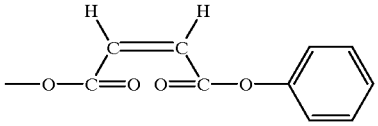

derived from phenylmaleic acid,

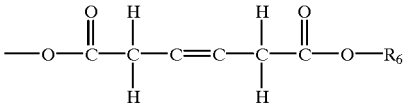

derived from 3-hexene-1,6-dicarboxylic acid and the like. Preferably, these derivatives from a dibasic or polybasic acid contain from 3 to about 20 carbon atoms. The expression "monobasic organic acid" as employed herein is defined as an organic acid containing a single carboxyl group. The expression "polybasic organic acid" as employed herein is defined as an organic acid containing a plurality of carboxyl groups. When $R_5$ is derived from a polybasic acid, only one of the carboxyl groups is utilized in the reaction with a formaldehyde to form a functional group attached a phenylene group of the bisphenol moiety of the cross linkable polymer. The other carboxyl group is preferably rendered substantially inactive by the presence of a suitable group represented by $R_6$. Any suitable group, preferably free of any urethane linkage, may be utilized for $R_6$. Typical groups for $R_6$ include, for example, methyl, ethyl, propyl, phenyl, substituted phenyl, substituted alkyl, and the like. These groups preferably contain from 1 to 20 carbon atoms.

Z in the above formula is a group of atoms necessary to constitute a substituted or unsubstituted carbon ring or substituted or unsubstituted heterocyclic ring. Preferably, the ring contains from 3 to 20 carbon atoms. Any suitable group of atoms necessary to constitute a substituted or unsubstituted carbon ring or substituted or unsubstituted heterocyclic ring may be employed for Z. Typical groups include, for example, cyclohexyl, cyclopentyl, cyclooctyl, cycloheptyl, and the like.

The value of n for the cross linkable polymers of this invention is such that the weight average molecular weight of the material typically is from about 1,000 to about 300,000, preferably from about 25,000 to about 100,000, more preferably from about 50,000 to about 75,000, and even more preferably about 65,000, although the weight average molecular weight can be outside these ranges. The cross linkable polymer should be solvent soluble prior to cross linking and solvent insoluble after cross linking.

The cross linkable aromatic polymers of this invention prior to cross linking preferably have a glass transition temperature of from about 50° C. to about 350° C., and more preferably from about 150° C. to about 260° C., although the Tg can be outside these ranges. When the polymers are admixed with other components of the photosensitive imaging member into which they will be incorporated, such as charge transport molecules to form a charge transport layer, the polymer-containing mixture preferably has a glass transition temperature of from about 50° C. to about 100° C., and more preferably about 70° C., although the Tg of the mixture can be outside this range. The Tg of the crosslinkable polymer compositions is not especially significant unless the layers are so tacky that they prevent roll-up during some manufacturing processes. Cross linking provides structural integrity even to low Tg materials.

Processes for the preparation of the polymers of Formula I and II prior to and after functionalizing materials are known, and disclosed in, for example, P. M. Hergenrother et al., "Poly(arylene ethers)", Polymer, Vol. 29, 358 (1988); S. J. Havens et al., "Ethynyl-Terminated Polyarylates: Synthesis and Characterization," Journal of Polymer Science, Polymer Chemistry Edition, Vol. 22, 3011 (1984); B. J. Jensen and P. M. Hergenrother, "High Performance Polymers," Vol. 1, No. 1) page 31 (1989); "Synthesis and characterization of New Fluorescent Poly(arylene ethers)," S. Matsuo, N. Yakoh, S. Chino, M. Mitani, and S. Tagami, Journal of Polymer Science: Part A: Polymer Chemistry, 32, 1071 (1994); "Synthesis of a Novel Naphthalene-Based Poly (arylene ether ketone) with High Solubility and Thermal Stability," Mami Ohno, Toshikazu Takata, and Takeshi Endo, Macromolecules, 27, 3447 (1994); G. Hougham, G. Tesoro, and J. Shaw, Polym. Mater. Sci. Eng., 61, 369 (1989); "Synthesis and Characterization of New Aromatic Poly(ether ketones)," F. W. Mercer, M. T. Mckenzie, G. Merlino, and M. M. Fone, J. of Applied Polymer Science, 56, 1397 (1995); K. E. Dukes, M. D. Forbes, A. S. Jeevarajan, A. M. Belu, J. M. DeDimone, R. W. Linton, and V. V. Sheares, Macromolecules, 29, 3081 (1996); H. C. Zhang, T. L. Chen, Y. G. Yuan, Chinese Patent CN 85108751 (1991); "Static and laser light scattering study of novel thermoplastics. 1. Phenolphthalein poly(aryl ether ketone)," C. Wu, S. Bo, M. Siddiq, G. Yang and T. Chen, Macromolecules, 29, 2989 (1996); the disclosures of each of which are totally incorporated herein by reference.

The terminal groups on the cross linkable polymer in some instances, can be selected by the stoichiometry of the polymer synthesis. For example, when a polymer is prepared by the reaction of 4,4'-dichlorobenzophenone and bisphenol A in the presence of potassium carbonate in N,N-dimethylacetamide, if the bis-phenol A is present in about 7.5 to 8 mole percent excess, the resulting polymer generally is bis-phenol A terminated (wherein the bis-phenol A moiety may or may not have one or more hydroxy groups thereon), and the resulting polymer typically has a polydispersity ($M_w/M_n$) of from about 2 to about 3.5, although the polydispersity can be outside this range. When a bisphenol A-terminated polymer is subjected to further reactions to place functional groups thereon, such as haloalkyl groups, and/or to convert one kind of functional group, such as a haloalkyl group, to another kind of functional group, such as an unsaturated —$CH_2$—$R_5$ group wherein $R_5$ is a group derived from a monobasic or polybasic organic acid containing a reactive double bond, the polydispersity of the polymer can rise to the range of from about 4 to about 6. In contrast, if for example, 4,4'-dichlorobenzophenone is present in about 7.5 to 8 mole percent excess, the reaction time is approximately half that required for the bis-phenol A excess reaction, the resulting polymer generally is benzophenone-terminated (wherein the benzophenone moiety may or may not have one or more chlorine atoms thereon), and the resulting polymer typically has a polydispersity of from about 2 to about 3.5. When the benzophenone-terminated polymer is subjected to further reactions to place functional groups thereon, such as unsaturated —$CH_2$—$R_5$ groups, and/or to convert one kind of functional group, such as a haloalkyl group, to another kind of functional group, such as an unsaturated —$CH_2$—$R_5$ group, the polydispersity of the polymer typically remains in the range of from about 2 to about 3.5. Similarly, when a polymer is prepared by the reaction of 4,4'-difluorobenzophenone with either 9,9'-bis(4-hydroxyphenyl)fluorene or bis-phenol A in the presence of potassium carbonate in N,N-dimethylacetamide, if the 4,4'-difluorobenzophenone reactant is present in excess, the resulting polymer generally has benzophenone terminal groups (which may or may not have one or more fluorine atoms thereon). The well-known Carothers equation can be employed to calculate the stoichiometric offset required to obtain the desired molecular weight. [See, for example, William H. Carothers, "An Introduction to the General Theory of Condensation Polymers," *Chem. Rev.,* 8, 353 (1931) and *J. Amer. Chem. Soc.,* 51, 2548 (1929); see also P. J. Flory, *Principles of Polymer Chemistry*, Cornell University Press, Ithaca, New York (1953); the entire disclosures of each being incorporated herein by reference]. More generally speaking, during the preparation of polymers the stoichiometry of the polymer synthesis reaction can be adjusted so that the end groups of the polymer are derived from the benzophenone groups or derived from the groups attached to the benzophenone groups. Specific functional groups can also be present on these terminal benzophenone groups or groups attached to the benzophenone, such as ethynyl groups or other thermally sensitive groups, hydroxy groups which are attached to the aromatic ring on benzophenone groups or groups attached to the benzophenone groups to form a phenolic moiety, halogen atoms which are attached to the benzophenone groups or groups attached to the benzophenone groups, or the like. Moreover, the addition of phenol late in the polymerization reaction during polymer preparation is a method to introduce phenyl-ether end groups. This process is demonstrated in Example 6.

Polymers with end groups derived from the benzophenone groups or halogenated benzophenone groups, may be preferred for some applications because both the syntheses and some of the reactions of these materials to place substituents thereon may be easier to control and may yield better results with respect to, for example, cost, molecular weight, molecular weight range, and polydispersity ($M_w/M_n$) compared to polymers with end groups derived from the groups attached to the benzophenone group, such as bisphenol A groups (having one or more hydroxy groups on the aromatic rings thereof) or other phenolic groups. While not being limited to any particular theory, it is believed that the haloalkylation reaction in particular proceeds most rapidly on the phenolic tails when the polymer is bis-phenol A terminated. Moreover, it is believed that halomethylated groups on phenolic-terminated polymers may be particularly reactive to subsequent crosslinking or chain extension. In contrast, it is generally believed that halomethylation does not take place on the terminal aromatic groups with electron withdrawing substituents, such as benzophenone, halogenated benzophenone, or the like.

Typical polyarylene ether ketones which can be functionalized for cross linking include the following

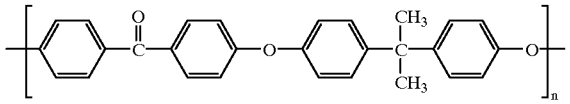

wherein n represents the number of repeating monomer units, and typically is from about 25 to about 620, and preferably from about 74 to about 150, although the value of n can be outside these ranges, in some specific embodiments with a glass transition temperature of about 155° C. These polyarylene ether ketones represented by the above formulae are known and described, for example in U.S. Pat. No. 5,814,426, the entire disclosure thereof being incorporated herein by reference.

Polyarylene ether ketones functionalized with polymerizable groups are essential precursors to an embodiment of the cross-linked matrix of this invention. Any suitable polymerizable group, preferably free of any urethane linkage, and containing double bond unsaturation may be employed for functionalizing. Preferably, the polyarylene ether ketone is functionalized by reacting the polymer with (i) a formaldehyde source, and (ii) an unsaturated acid in the presence of an acid catalyst, thereby forming a cross linkable polymer with unsaturated —$CH_2$—$R_5$ groups. As described above, $R_5$ is a group derived from a monobasic or polybasic organic acid containing a reactive double bond. Typical monobasic and polybasic organic acids containing a reactive double bond used to form the polymerizable functionalizing groups include, for example, acrylic acid, methacrylic acid, cinnamic acid, crotonic acid, ethacrylic acid, oleic acid, linoleic acid, maleic acid, fumaric acid, itaconic acid, citraconic acid, phenylmaleic acid, 3-hexene-1,6-dicarboxylic acid, and the like. Acrylic acid derived functional groups attached to the cross linkable polymers are especially preferred because they function as good binders for charge transport molecules and can be easily cross linked in the presence of the transport molecules by the action of light or heat without negatively affecting the charge transport characteristics of the final charge transport layer.

Prior to cross linking, the functionalized polymer preferably has a weight average molecular weight of from about 3,000 to about 75,000 Daltons, and more preferably has a number average molecular weight of from about 5,000 to about 50,000 Daltons, and ever more preferably has a number average molecular weight of from about 25,000 to about 50,000 Daltons, although the molecular weight can be outside these ranges. The functionalization of the basic polymer is accomplished by reacting the polymer in solution with (a) the appropriate unsaturated carboxylic acid (such as acrylic acid, methacrylic acid, cinnamic acid, crotonic acid, ethacrylic acid, oleic acid, linoleic acid, maleic acid, fumaric acid, itaconic acid, citraconic acid, phenylmaleic acid, 3-hexene-1,6-dicarboxylic acid, or the like), and (b) a formaldehyde source (e.g., formaldehyde or a material which, under the conditions of the reaction, generates formaldehyde such as, formaldehyde sources other than formaldehyde itself including, for example, paraformaldehyde, trioxane, methylal, dimethoxymethane, and the like). The reaction is direct acid catalyzed; the polymer is dissolved in a suitable solvent, such as 1,1,2,2-tetrachloroethane or the like, and is allowed to react with the formaldehyde source at about 105° C. in the presence of catalytic amounts of a catalyst such as para-toluenesulfonic acid. Examples of solvents suitable for the reaction include 1,1,2,2-tetrachloroethane, as well as methylene chloride, provided a suitable pressure reactor is used. Typically, the reactants are present in relative amounts with respect to each other (by weight) of about 10 parts polymer, about 5 parts formaldehyde source, about 1 part paratoluenesulfonic acid, about 15.8 parts of the appropriate unsaturated carboxylic acid (e.g., acrylic acid, methacrylic acid, or the like), about 0.2 parts hydroquinone methyl ether, and about 162 parts 1,1,2,2-tetrachloroethane. The above reaction applies mostly to lower molecular weight polyarylene ether ketones based on bisphenol A. This reaction goes poorly with polycarbonates and high-molecular weight polyarylene ether ketones based on fluorenone-bisphenol. It was not tried with polystyrene. However, all these polymers (polyarylene ether ketones, polycarbonates, polyarylene ether sulfones, and polystyrenes can be chloromethylated, and then the chloromethylated groups are then replaced with groups with carbon to carbon double bonds.

The general reaction scheme, illustrated below for a reaction with acrylic acid to attach acryloxymethyl functional groups, is as follows:

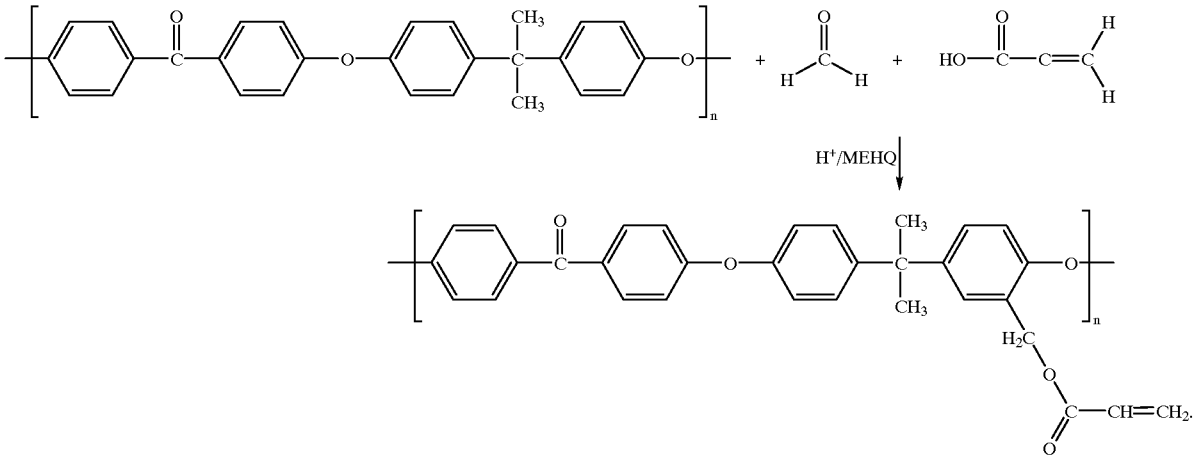

Other species of polymers with attached acyloxymethyl functional groups include

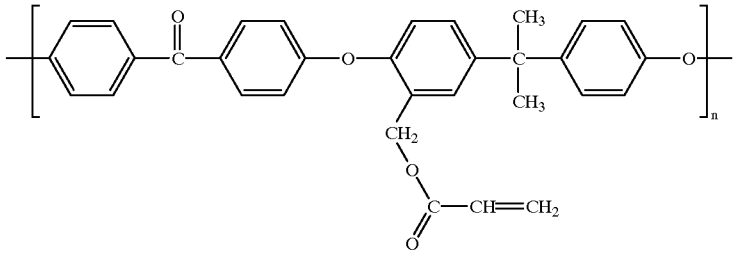

and

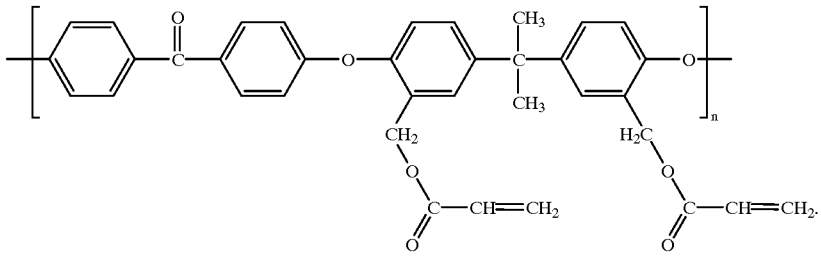

Thus, these materials may be represented by the general formula

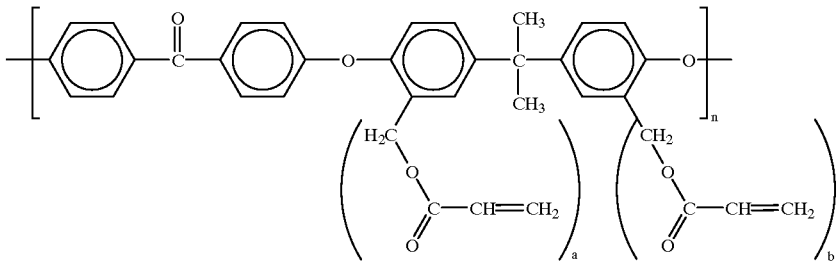

wherein a and b are each integers of 0 or 1, provided that at least one of a or b is equal to or greater than 1 in at least some of the monomer repeat units of the polymer, and n is an integer representing the number of repeating monomer units. If desired, these monomer units may be part of a homopolymer, copolymer, terpolymer or the like. The polymer should contain a sufficient number of monomer units containing functional groups to form a solvent insoluble matrix when cross linked. When methacrylic acid is used, the reaction proceeds as shown above except that the

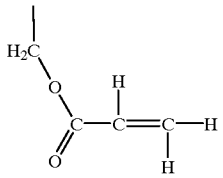

groups shown above are replaced with

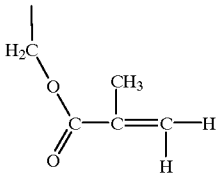

groups. When cinnamic acid is used, the reaction proceeds as shown above except that the

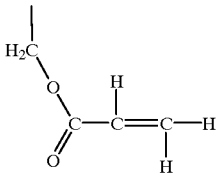

groups shown above are replaced with

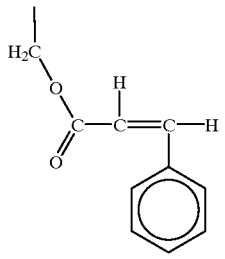

groups. Substitution is generally random, although the substituent may show a preference for the group derived from bisphenol, and any given monomer repeat unit may have no substituents, one substituent, or two or more substituents. The most likely result of the reaction is that a monomer repeat unit will have 0 or 1 substituents.

Typical reaction temperatures are from about 25° C. to about 145° C., and preferably about 105° C., although the temperature can be outside this range. Typical reaction times are from about 1 to about 6 hours, and preferably from about 2 hours to about 4 hours, although the time can be outside these ranges. Longer reaction times generally result in higher degrees of substitution. Higher degrees of substitution generally lead to greater reactivity and ultimately to greater crosslinking and solvent-resistance of the polymer, and different degrees of substitution may be desirable for different applications. Too low a degree of substitution may be undesirable because bias charging roll wear resistance is not improved and solvent resistance is reduced due to low crosslink density. The degree of substitution (i.e., the average number of unsaturated ester groups per monomer repeat unit) preferably is from about 0.25 to about 1.2, and more preferably from about 0.65 to about 0.8, although the degree of substitution can be outside these ranges. This degree of substitution generally corresponds to from about 0.5 to about 1.3 milliequivalents of unsaturated acidoxymethylene (i.e., —$CH_2$—$R_5$) groups per gram of resin.

Other procedures for placing functional groups on aromatic polymers are disclosed in, for example, W. H. Daly, S. Chotiwana, and R. Nielsen, *Polymer Preprints,* 20, (1), 835 (1979); "Functional Polymers and Sequential Copolymers by Phase Transfer Catalysis, 3. Synthesis And Characterization of Aromatic Poly(ether sulfone)s and Poly(oxy-2,6-dimethyl-1,4-phenylene) Containing Pendant Vinyl Groups," V. Percec and B. C. Auman, *Makromol. Chem.,* 185, 2319 (1984); F. Wang and J. Roovers, *Journal of Polymer Science: Part A: Polymer Chemistry,* 32, 2413 (1994); "Details Concerning the Chloromethylation of Soluble High Molecular Weight Polystyrene Using Dimethoxymethane, Thionyl Chloride, And a Lewis Acid: A Full Analysis," M. E. Wright, E. G. Toplikar, and S. A. Svejda, *Macromolecules,* 24, 5879 (1991); "Functional Polymers and Sequential Copolymers by Phase Transfer Catalysts," V. Percec and P. L. Rinaldi, *Polymer Bulletin,* 10, 223 (1983); "Preparation of Polymer Resin and Inorganic Oxide Supported Peroxy-Acids and Their Use in the Oxidation of Tetrahydrothiophene," J. A. Greig, R. D. Hancock, and D. C. Sherrington, Euopean Polymer J., 16, 293 (1980); "Preparation of Poly(vinylbenzyltriphenylphosphonium Perbromide) and Its Application in the Bromination of Organic Compounds," A. Akelah, M. Hassanein, and F. Abdel-Galil, *European Polymer J.,* 20 (3) 221 (1984); J. M. J. Frechet and K. K. Haque, *Macromelcules,* 8, 130 (1975); U.S. Pat. No. 3,914,194; U.S. Pat. No. 4,110,279; U.S. Pat. No. 3,367,914; "Synthesis of Intermediates for Production of Heat Resistant Polymers (Chloromethylation of Diphenyl oxide)," E. P. Tepenitsyna, M. I. Farberov, and A. P. lvanovski, *Zhurnal Prikladnoi Khimii, Vol.* 40, No. 11, 2540 (1967); U.S. Pat. No. 3,000,839; Chem Abst. 56, 590f (1962); U.S. Pat. No. 3,128,258; Chem Abstr. 61, 4560a (1964); J. D. Doedens and H. P. Cordts, *Ind. Eng. Ch.,* 83, 59 (1961); British Patent 863,702; and Chem Abstr 55, 18667b (1961); the entire disclosures of each being incorporated herein by reference.

Typical polyarylene ether ketones functionalized with acryloxymethylene groups include the following:

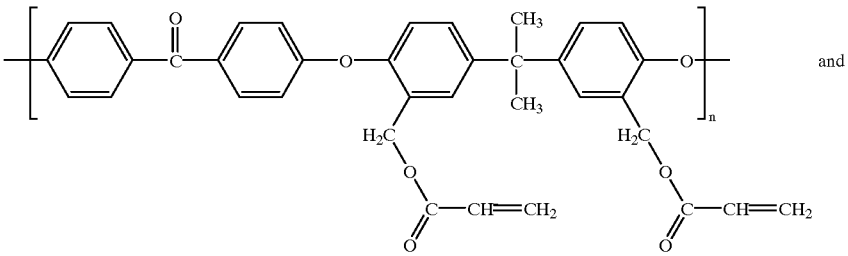

and

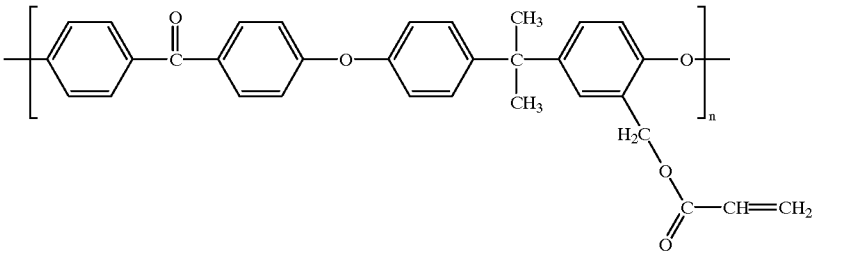

These polyarylene ether ketones functionalized with acryloxymethylene groups are plasma resistant photoresists which are also resistant to bias charging roll degradation and solvents when sufficiently cross linked to be solvent insoluble. Generally, cross linking occurs after heating for more than about 10 minutes at 120° C. Cross linking may be determined by testing the insolubility of the cross linking resin to tetrahydrofuran. When the resins do not dissolve in tetrahydrofuran, they are considered sufficiently cross linked. Cross linked resins may retain some flexibility dependent on the amount of crosslinkable functional groups attached to the polymer. These polyarylene ether ketones, functionalized with unsaturated acidoxymethylene groups such as acryloxymethylene groups may be homopolymers, copolymers or terpolymers and are fully compatible with small molecule charge transport molecules such as arylamine charge transport molecules. For example, the polyarylene ether ketones functionalized with acryloxymethylene groups, represented by the structures illustrated above blended with N,N'-diphenyl-N,N'-bis(3"-methylphenyl)-(1,1'-biphenyl)-4,4'-diamine in a 1:1 weight ratio form clear, transparent films which can be coated from common solvents such as methylene chloride, toluene, and the like, and cross linked either at elevated temperatures of the order of between about 80° C. and about 120° C. or by exposure to UV light. Heat treatment may be used to drive off the coating solvent. These films containing charge transporting arylamine small molecules display charge carrier mobilities of about the same magnitude as seen with charge transporting layers containing charge transporting arylamine small molecules in a polycarbonate binder at comparable weight concentrations of the binder to small molecule. The degree of crosslinking can be controlled primarily by varying the content of the polymerizable functional groups. As defined above, the expression "polymerizable functional groups" refers to a reactive alkenyl or olefinic group (i.e., containing at least one unsaturated carbon to carbon double bond) capable of addition reaction. The number of crosslinkable groups can be reported as, for example, moles of unsaturated acidoxymethylene groups per repeat unit, or as milliequivalents of unsaturated acidoxymethylene groups per gram of resin solids. Where the polymer is a copolymer or terpolymer, some of the repeat units may be free of polymerizable functional groups for cross linking so long as the final cross linked polymer matrix is insoluble in solvents. Thus, the expression "repeat unit" includes other monomers which are connected to the functionalized segment to form a copolymer or terpolymer. The final charge transport layer matrix, after cross linking of the cross linkable polyarylene ether ketone polymer, is insoluble in solvents. Any solvent used to apply the charge transport layer coating prior to cross linking is substantially removed prior to and/or during the cross linking of the cross linkable polyarylene ether ketone polymer.

Other typical examples of cross linkable polymers include acryloxy-methyl substituted -polycarbonates, -polyarylene ether sulfones, and -polystyrenes with the following structures:

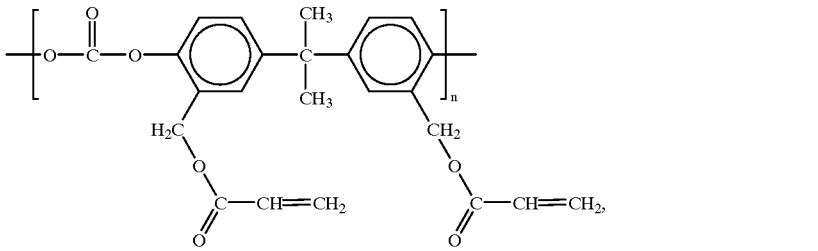

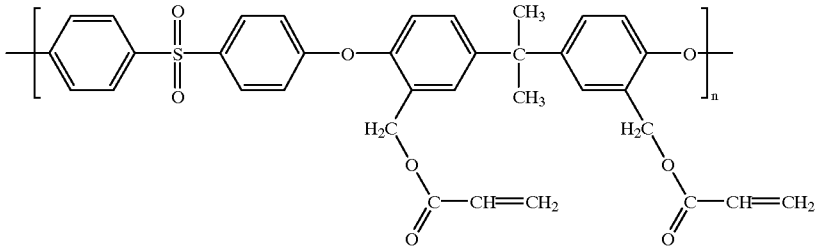

and

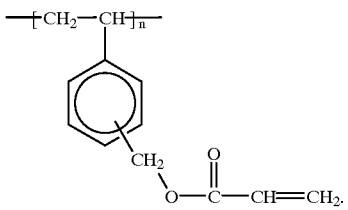

In one embodiment, a polymer cross linked to form the matrix in the charge transport layer of this invention contains the benzophenone group represented by the following formula

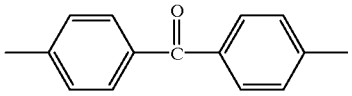

which is believed to sensitize the unsaturated acidoxymethylene functionalized basic polymer segment whereby photopolymerization of the unsaturated acidoxymethylene groups can be accomplished. Once the crosslinking reaction is completed, the benzophenone group does not appear to have any influence on the transport molecule.

If desired, the polyarylene ether ketones or other olefinic substituted polymers (see above) functionalized with polymerizable groups can optionally be co-cross polymerized in the presence of any suitable co-monomer having double bond unsaturation capable of cross addition polymerization with the functionalized polyarylene ether ketone or other olefinic substituted polymers. Typical co-monomers having double bond unsaturation include vinyl co-monomers such as, for example, styrene, alkyl methacrylates containing 5 or more carbon atoms, acrylate esters, methacrylate esters, functionalized styrene monomers, acrylated triarylamine compounds, vinyl carbazole, vinyl substituted arylamine compounds, vinyl substituted monomers, and the like, to form plasma (bias charging roll) resistant cross linked networks fully compatible with a charge transport moiety, with physical characteristics that are dependent on the nature of the co-monomers used. The cross linking step may be carried out in the presence of another vinyl monomer such as styrene, long chain alkyl methacrylates and the like by simply adding the vinyl monomer to the coating solution containing small molecule charge transport arylamine and the polyarylene ether ketone functionalized with an acidoxymethylene group (binder precursor) to form a coating solution, applying the solution to a member to form a coating, and simultaneously or sequentially exposing the deposited coating to heat or UV light. Highly crosslinked structures containing the acidoxymethylene group functionalized polyarylene ether ketone cross-copolymerized with polystyrene are formed in this manner.

A typical polyarylene ether ketone functionalized with polymerizable groups and co-cross polymerized in the presence of styrene is illustrated below:

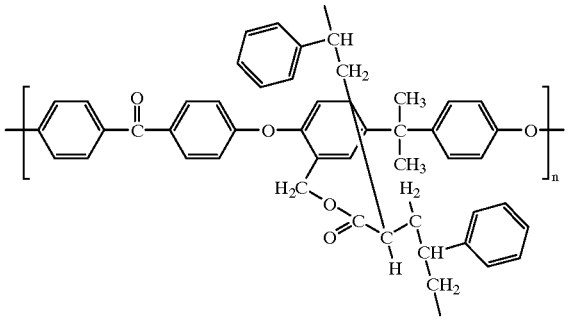

Charge carrier mobilities of these charge transport layers depend on the relative content of the added co-monomer. Thus, for example, a polymer network containing approximately 30 parts by weight styrene, 35 parts by weight of the base acryloxymethylene functionalized polymer and 35 percent by weight arylamine charge transport small molecule [N,N'-diphenyl-N,N'-bis(3"-methylphenyl)-(1,1'-biphenyl)-4,4'-diamine] are close to $10^{-8}$ $cm^2$N.s, as expected for a composition containing about 35 weight percent arylamine charge transport molecule.

The nature of any co-monomer employed will influence the final properties of the films, such as surface tension, toughness, and the like. For example, co-monomers with a high content of fluoroalkyl groups will change the surface tension whereas a phenoxy acrylate group will add toughness, and the like. The functionalized polyarylene ether ketone or the other functionalized polymers including polystyrenes, polycarbonates, polyarylene ether sulfones and the like, can be added in amounts ranging from about 1 percent to about 99 percent by weight based on the total weight of the polymer with the remainder being the co-monomer. Preferred values are between about 25 and about 50 percent by weight dependent on solution coating viscosity and the final properties of the films produced. In this way, high solids, solvent-less or solvent reduced coating solutions can be made.

An alternative embodiment to the formula above without affecting crosslinkability of the acidoxymethylene- modified functionalized polyarylene ether ketone structures and miscibility with the charge transport small molecule is represented by the following formula

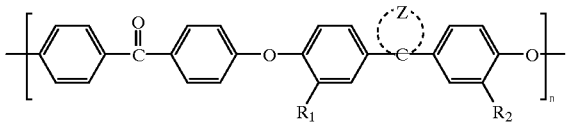

wherein Z, $R_1$ and $R_3$ have previously been defined. A typical specific embodiment of a alternative basic polymer formula prior to functionalization is represented by the following structural formula:

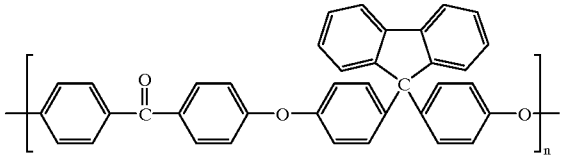

wherein n represents the number of repeating monomer units, and typically is from about 20 to about 475, and preferably from about 55 to about 114, although the value of n can be outside these ranges. In some specific embodiments, the polymer can have, for example, a glass transition temperature of about 240° C. This polyarylene ether ketone represented by the above formulae is known and described, for example in U.S. Pat. No. 5,814,426, the entire disclosure thereof being incorporated herein by reference. The corresponding polycarbonates and polyarylene ether sulfones can also be used in embodiments.

Another typical embodiment of a changed basic polymer structure prior to functionalization is a fluoromethyl derivative represented by the following structural formula:

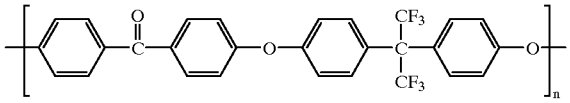

wherein n represents the number of repeating monomer units, and typically is from about 10 to about 620, and preferably from about 55 to about 114, although the value of n can be outside these ranges. These molecules must be formulated with hole transporting small molecules to be useful in a charge transport layer. Moreover, these molecules must be cross linked and solvent insoluble in the final transport layer.

The active charge transport layer comprises an activating compound useful as an additive molecularly dispersed or dissolved in the cross linked matrix derived from a cross linkable aromatic polymer with substituent groups containing unsaturated carbon to carbon double bond, the substituent groups being attached to phenylene groups. These activating compounds may be added to cross linkable polyarylene ether ketone embodiments which are incapable of supporting the injection of photogenerated holes from the generation material and incapable of allowing the transport of these holes therethrough, thereby converting the electrically inactive polymeric material to a material capable of supporting the injection of photogenerated holes from the generation material and capable of allowing the transport of these holes through the active layer in order to discharge the surface charge on the active layer. An especially preferred transport layer comprises from about 25 percent to about 75 percent by weight of at least one charge transporting compound, and from about 75 percent to about 25 percent by weight of a cross linkable polyarylene ether ketone in which the aromatic amine is soluble, the percent by weight being based on the total weight of the final dried transport layer.

Any suitable charge transporting material may be employed in the charge transport layer with the cross linkable polyarylene ether ketone. Typical charge transporting materials include, for example, diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, U.S. Pat. No. 4,265,990, and U.S. Pat. No. 4,081,274, the entire disclosures of each of being incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the entire disclosures of each being incorporated herein by reference. Typical pyrazoline transport molecules include 1 -[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, 2 the entire disclosure of which is incorporated herein by reference. Typical fluorene charge 3 transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the entire disclosures of each being incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. No. 4,150,987, U.S. Pat. No. 4,385,106, U.S. Pat. No. 4,338,388, and U.S. Pat. No. 4,387,147, the entire disclosures of each being incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1 -phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the entire disclosures of each being incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the entire disclosure being incorporated herein by reference.

Oxadiazole derivatives such as 2,5-bis-(p-diethylaminophenyl)-oxadiazole-1,3,4 described in U.S. Pat. No. 3,895,944, the entire disclosure being incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the entire disclosure being incorporated herein by reference.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the entire disclosure being incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-o-toluene, 4,6-dichloro-1,3-dinitrobenzene, 4,6-dibromo-1,3-dinitrobenzene, p-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, sulfonyl, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the entire disclosure being incorporated herein by reference.

Other typical charge transport materials include triarylamines, including tritolyl amine, and the like, as disclosed in, for example, U.S. Pat. No. 3,240,597 and U.S. Pat. No. 3,180,730, the entire disclosures of each being incorporated herein by reference, and substituted diarylmethane and triarylmethane compounds, including bis-(4-diethylamino-2-methylphenyl)-phenylmethane, and the like, as disclosed in, for example, U.S. Pat. No. 4,082,551, U.S. Pat. No. 3,755,310, U.S. Pat. No. 3,647,431, British Patent 984,965, British Patent 980,879, and British Patent 1,141, 666, the entire disclosures of each being incorporated herein by reference.

A particularly preferred charge transport molecule is one having the general formula

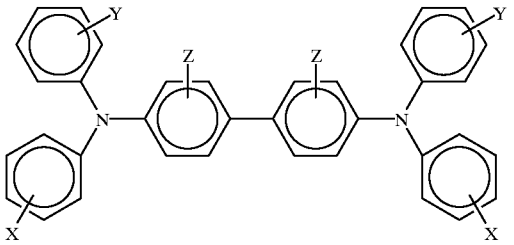

wherein X, Y and Z are each, independently of the others, hydrogen, halogen (for example chlorine), alkyl groups having from 1 to about 20 carbon atoms, and wherein at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. A particularly preferred member of this class is N,N'-diphenyl-N,N'-bis(3"-methylphenyl)-(1,1'-biphenyl)-4,4'-diamine (prepared as disclosed in U.S. Pat. No. 4,265, 990, the entire disclosure being incorporated herein by reference).

Any suitable solvent that dissolves the cross linkable aromatic polymer and the charge transport material may be employed to form a coating solution for the charge transport layer. Typical solvents include, for example, methylene chloride, tetrahydrofuran, toluene, mixtures thereof, and the like. If desired, the solvent for the cross linkable aromatic polymer and the charge transport material can be a coreactive monomer. Thus, while functioning as solvent, the coreactive monomer can produce high solids or solvent-less coating solutions. As described above, the coreactive monomer can be present in the coating solution in an amount from about 1 percent to about 99 percent by weight based on the total amount of resin solids.

Any suitable and conventional technique may be utilized to mix and thereafter apply the charge transport layer coating mixture to the charge generating layer. Typical application techniques include spraying, dip coating, roll coating, wire wound rod coating, slot coating, and the like. Drying of the deposited coating may be effected by any suitable conventional technique such as oven drying, infra red radiation drying, air drying and the like. When thermal sensitivity imparting groups are present, the polymers of the present invention are cured in a two-stage process which entails (a) exposing the polymer to actinic radiation, thereby causing the polymer to become crosslinked through the photosensitivity-imparting groups; and (b) subsequent to step (a), heating the polymer to a temperature of at least about 120° C., and preferably about 140° C., thereby causing further cross linking of the polymer through the thermal sensitivity imparting groups. Moreover, free radical catalysts such azobisisobutyronitrile can be added to accelerate the thermal cure of these systems. When benzoyl peroxide is added as a catalyst, oxidation of the triarylamine hole transporting molecules takes place and the compositions become conductive.

The cross linkable polymer can be cured by uniform exposure to actinic radiation at wavelengths and/or energy levels capable of causing crosslinking of the polymer through the photosensitivity-imparting groups. Alternatively, the cross linkable polymer is cross linked by exposure of the material to radiation at a wavelength and/or at an energy level to which the cross linking groups are sensitive. Typically, a charge transport layer composition will contain the cross linkable polymer, an optional solvent for the cross linkable polymer, an optional sensitizer, and an optional photoinitiator. Solvents may be particularly desirable when the uncrosslinked polymer has a high $T_g$. The solvent and cross linkable polymer typically are present in relative amounts of from 0 to about 99 percent by weight solvent and from about 1 to 100 percent polymer, preferably are present in relative amounts of from about 20 to about 60 percent by weight solvent and from about 40 to about 80 percent by weight polymer, and more preferably are present in relative amounts of from about 30 to about 60 percent by weight solvent and from about 40 to about 70 percent by weight polymer, although the relative amounts can be outside these ranges.

Sensitizers absorb light energy and facilitate the transfer of energy to unsaturated bonds which can then react to cross link or chain extend the resin. Sensitizers frequently expand the useful energy wavelength range for actinic curing, and typically are aromatic light absorbing chromophores. Sensitizers can also lead to the formation of photoinitiators, which can be free radical or ionic. When present, the optional sensitizer and the cross linkable polymer typically are present in relative amounts of from about 0.1 to about 20 percent by weight sensitizer and from about 80 to about 99.9 percent by weight cross linkable polymer, and preferably are present in relative amounts of from about 1 to about 10 percent by weight sensitizer and from about 90 to about 99 percent by weight cross linkable polymer, although the relative amounts can be outside these ranges.

Photoinitiators generally generate ions or free radicals which initiate polymerization upon exposure to actinic radiation. When present, the optional photoinitiator and the cross linkable polymer typically are present in relative amounts of from about 0.1 to about 20 percent by weight photoinitiator and from about 80 to about 99.9 percent by weight cross linkable polymer, and preferably are present in relative amounts of from about 1 to about 10 percent by weight photoinitiator and from about 90 to about 99 percent by weight cross linkable polymer, although the relative amounts can be outside these ranges. A single material can also function as both a sensitizer and a photoinitiator Examples of specific sensitizers and photoinitiators include Michler's ketone (Aldrich Chemical Co.), Darocure 1173, Darocure 4265, Irgacure 184, Irgacure 261, and Irgacure 907 (available from Ciba-Geigy, Ardsley, N.Y.), and mixtures thereof. Further background material on initiators is disclosed in, for example, Ober et al., J. M. S.—*Pure Appl. Chem.*, A30 (12), 877–897 (1993); G. E. Green, B. P. Stark, and S. A. Zahir, "Photocrosslinkable Resin Systems," *J. Macro. Sci.—Revs. Macro. Chem.*, C21(2), 187 (1981); H. F. Gruber, "Photoinitiators for Free Radical Polymerization," *Prog. Polym. Sci.,* Vol. 17, 953 (1992); Johann G. Kloosterboer, "Network Formation by Chain Crosslinking Photopolymerization and Its Applications in Electronics," *Advances in Polymer Science,* 89, Springer-Verlag Berlin Heidelberg (1988); and "Diaryliodonium Salts as Thermal Initiators of Cationic Polymerization," J. V. Crivello, T. P. Lockhart, and J. L. Lee, *J. of Polymer Science: Polymer Chemistry Edition,* 21, 97 (1983), the entire disclosures of each being incorporated herein by reference. Sensitizers are available from, for example, Aldrich Chemical Co., Milwaukee, Wis., and Pfaltz and Bauer, Waterberry, Conn. Benzophenone and its derivatives can function as photosensitizers. Triphenylsulfonium and diphenyl iodonium salts are examples of typical cationic photoinitiators.

While not being limited to any particular theory, it is believed that exposure to, for example, ultraviolet radiation generally opens the ethylenic linkage in the acidoxymethylene groups and leads to cross linking. Many of the photosensitivity-imparting groups which are indicated above as being capable of enabling cross linking of the polymer upon exposure to actinic radiation can also enable cross linking of the polymer upon exposure to elevated temperatures; thus the polymers of the present invention can also, if desired, be used in applications wherein thermal curing is employed.

The charge transport material is present in the charge transport layer in any effective amount, generally from about 5 to about 90 percent by weight, preferably from about 20 to about 75 percent by weight, and more preferably from about 30 to about 60 percent by weight, based on the total dried weight of the charge transport layer, although the amount can be outside of these ranges.

Generally, the thickness of the charge transport layer is from about 10 to about 50 micrometers, although thicknesses outside this range can also be used. Preferably, the ratio of the thickness of the charge transport layer to the charge generator layer is maintained from about 2:1 to 200:1, and in some instances as great as 400:1.

Other layers, such as a conventional electrically conductive ground strip along one edge of the belt in contact with the conductive layer, blocking layer, adhesive layer or charge generating layer to facilitate connection of the electrically conductive layer of the photoreceptor to ground or to an electrical bias, may also be included. Ground strips are well known and usually comprise conductive particles dispersed in a film forming binder.

Optionally, an overcoat layer may also be utilized to improve resistance to abrasion. In some cases an anti-curl back coating may be applied to the back-side surface of the substrate opposite to that bearing the photoconductive layer to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. The total forces are substantially balanced when the belt has no noticeable tendency to curl after all the layers are dried. For example, for an electrophotographic imaging member in which the bulk of the coating thickness on the photoreceptor side of the imaging member is a transport layer containing predominantly polycarbonate resin and having a thickness of about 24 micrometers on a Mylar substrate having a thickness of about 76 micrometers, sufficient balance of forces can be achieved with a 13.5 micrometers thick anti-curl layer containing about 99 percent by weight polycarbonate resin, about 1 percent by weight polyester and between about 5 and about 20 percent of coupling agent treated crystalline particles. An example of an anti-curl backing layer is described in U.S. Pat. No. 4,654,284 the entire disclosure being incorporated herein by reference. A thickness between about 70 and about 160 micrometers is a satisfactory range for flexible photoreceptors.

The present invention also encompasses a method of generating images with the photoconductive imaging members disclosed herein. The method comprises the steps of forming an electrostatic latent image on a photoconductive imaging member of the present invention, developing the latent image with toner particles to form a toner image corresponding to the latent image, and transferring the toner image to a receiving member. Optionally, the transferred image can be permanently affixed to the receiving member. Development of the latent image may be achieved by a number of methods, such as cascade, touchdown, powder cloud, magnetic brush, and the like. Transfer of the developed toner image to a receiving member may be by any suitable method, including those making use of a corotron or a biased charging roll. The fixing step may be performed by means of any suitable method, such as radiant flash fusing, heat fusing, pressure fusing, vapor fusing, and the like. Any material used in xerographic copiers and printers may be used as a receiving member, such as paper, transparency material, or the like.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

A polymer of the formula

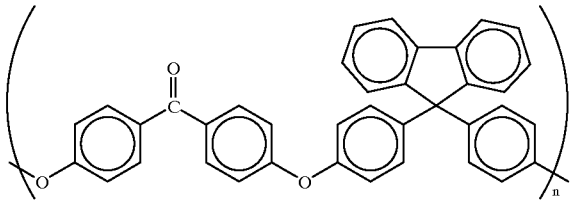

(hereinafter referred to as poly(4-FPK-FBPA)) wherein n is about 130 and represents the number of repeating monomer units was prepared as follows. A 1-liter, 3-neck round-bottom flask equipped with a Dean-Stark trap (Barrett) trap, condenser, mechanical stirrer, argon inlet, and stopper was situated in a silicone oil bath. 4,4'-Difluorobenzophenone (Aldrich Chemical Co., Milwaukee, Wis., 43.47 grams, 0.1992 mole), 9,9'-bis(4-hydroxyphenyl)fluorenone (Aldrich Chemical Co., 75.06 grams, 0.2145 mole) potassium carbonate (65.56 grams), anhydrous N,N-dimethylacetamide (300 milliliters), and toluene (52 milliliters) were added to the flask and heated to 175° C. (oil bath temperature) while the volatile toluene component was collected and removed. After 5 hours of heating at 175° C.

with continuous stirring, the reaction mixture was allowed to cool to 25° C. The solidified mass was extracted with methylene chloride, filtered and added to methanol to precipitate the polymer, which was collected by filtration, washed with water, and washed with methanol. The yield of vacuum dried product, poly(4-FPK-FBPA), was 71.7 grams. The polymer was analyzed by gel permeation chromatography using tetrahydrofuran as the elution solvent with the following results: Mn 59,100, Mpeak 144,000, and Mw 136,100. The glass transition temperature of the polymer was 240° C., as determined by using differential scanning calorimetry at a heating rate of 20° C. per minute. Solution cast films from methylene chloride were clear, tough, and flexible. As a result of the stoichiometries used in the reaction, it is believed that this polymer had hydroxyl end groups derived from fluorenone bisphenol.

EXAMPLE 2

Chloromethylation of Poly(4-FPK-FBPA)

A polymer of the structure

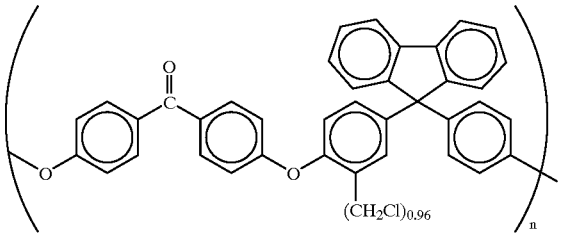

was made as follows. To a 5-liter 3-neck round-bottom flask equipped with a mechanical stirrer, reflux condenser, argon inlet and stopper that was situated in a silicone oil bath were added sequentially, acetyl chloride (388 grams, 320 milliliters), dimethoxymethane (450 milliliters), methanol (12.5 milliliters), tetrachloroethane (500 milliliters), and poly(4-FPK-FBPA) (100 grams, obtained from Scientific Polymer Products) in tetrachloroethane (1250 milliliters). To this was added tin tetrachloride (5 milliliters) via an air-tight syringe. The reaction mixture was heated for 2 hours at between 90° C. and 100° C. oil bath set temperature. After cooling to 25° C., the reaction mixture was added to methanol to reprecipitate the polymer with 0.96 chloromethyl groups per repeat unit.

EXAMPLE 3

Reaction of Chloromethylated Poly(4-FPK-FBPA) with Sodium Acrylate

A polymer of the structure

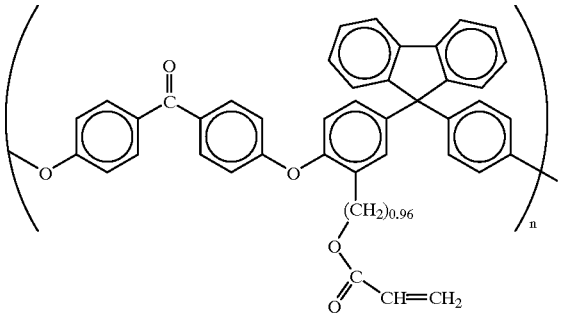

was made as follows. Chloromethylated poly(4-FPK-FBPA) (25 grams, from the example above) in N,N-dimethylacetamide (700 grams) was magnetically stirred with sodium acrylate (15 grams, Aldrich Chemical Co.) for one month at 25° C. The reaction solution was decanted off from the insoluble salts that settled out on centrifugation and was added to methanol to precipitate a white polymer that was filtered, washed with water and then methanol, and then was vacuum dried. The yield was 22.2 grams.

EXAMPLE 4

A polymer with the structure

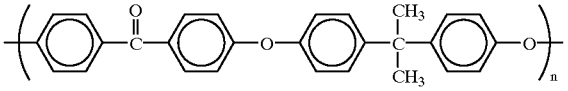

was made as follows. A 5-liter, 3-neck round-bottom flask equipped with a Dean-Stark trap (Barrett) trap, condenser, mechanical stirrer, argon inlet, and stopper was situated in a silicone oil bath. 4,4'-Dichlorobenzophenone (Aldrich Chemical Co., Milwaukee, Wis., 403.95 grams), bisphenol A (Aldrich Chemical Co., 340.87 grams), potassium carbonate (491.7 grams), anhydrous N,N-dimethylacetamide (2250 milliliters), and toluene (412.5 milliliters, 359.25 grams) were added to the flask and heated to 170° C. (oil bath temperature) while the volatile toluene component was collected and removed. After 48 hours of heating at 170° C. with continuous stirring, the reaction mixture was allowed to cool to 25° C. The reaction mixture was filtered to remove insoluble salts, and the solution was then added to methanol to precipitate the polymer. The polymer was isolated by filtration, washed with water and then methanol, and then was vacuum dried. After vacuum drying, the yield of polymer was 460 grams.

EXAMPLE 5

Chloromethylation of Poly(4-CPK-BPA)

A polymer with the structure

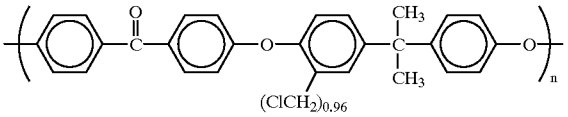

was made as follows. To a 5-liter 3-neck round-bottom flask equipped with a mechanical stirrer, reflux condenser, argon inlet and stopper that was situated in an ice bath were added sequentially, acetyl chloride (184 grams), dimethoxymethane (225 milliliters, 193 grams), methanol (6.25 milliliters), methylene chloride (500 milliliters), and poly(4-CPK-BPA) (75 grams, see above) in methylene chloride (625 milliliters). To this was added tin tetrachloride (6.5 milliliters) via an air-tight syringe. The reaction mixture was heated for 4 hours at 55° C. oil bath set temperature. After cooling to 25° C., the reaction mixture was added to methanol to reprecipitate the polymer with 0.96 chloromethyl groups per repeat unit.

EXAMPLE 6

A polymer with the structure

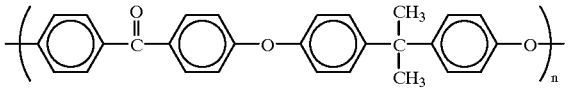

was made as follows. A 500-milliliter, 3-neck round-bottom flask equipped with a Dean-Stark trap (Barrett) trap, condenser, mechanical stirrer, argon inlet, and stopper was situated in a silicone oil bath. 4,4'-Difluorobenzophenone (Aldrich Chemical Co., Milwaukee, Wis., 21.82 grams), bisphenol A (Aldrich Chemical Co., 22.64 grams), potassium carbonate (40 grams), anhydrous N,N-dimethylacetamide (300 milliliters), and toluene (52 milliliters) were added to the flask and heated to 175° C. (oil bath temperature) while the volatile toluene component was collected and removed. After 5 hours of heating at 175° C. with continuous stirring, phenol (5 grams) was added and the reaction mixture was heated and stirred at 175° C. for 30 more minutes. The reaction mixture was allowed to cool to 25° C. The solidified mass was extracted with methylene chloride (500 milliliters) and filtered to remove insoluble salts. The solution was concentrated using a rotary evaporator and then was added to methanol to precipitate the polymer. The polymer was isolated by filtration, washed with water and then methanol, and then was vacuum dried. The yield of vacuum dried product, poly(4-FPK-BPA), was 40 grams.

EXAMPLE 7

Chloromethylation of Poly(4-FPK-BPA)

A polymer with the structure

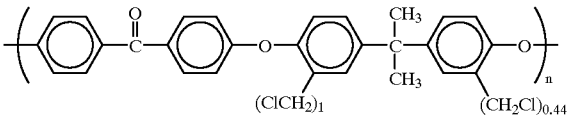

was made as follows. To a 1-liter 3-neck round-bottom flask equipped with a mechanical stirrer, reflux condenser, argon inlet and stopper that was situated in a silicone oil bath were added sequentially, acetyl chloride (140.1 grams, 128 milliliters), dimethoxymethane (157.6 grams), methanol (5 milliliters), tetrachloroethane (500 milliliters), and poly(4-FPK-BPA) (40 grams) in tetrachloroethane (500 milliliters). To this was added tin tetrachloride (0.6 milliliter) via an air-tight syringe. The reaction mixture was heated for 2 hours at 110° C. oil bath set temperature. After cooling to 25° C., the reaction mixture was added to methanol to reprecipitate the polymer with 1.44 chloromethyl groups per repeat unit.

EXAMPLE 8

A polymer with the structure

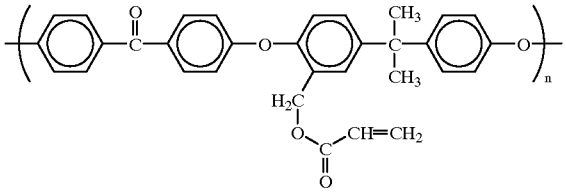

was made as follows. The chloromethylated polymer (Example 5, 15 grams) in N,N-dimethylacetamide (300 milliliters) was magnetically stirred with sodium acrylate (Aldrich Chemical Co., 9 grams) for one month. The reaction mixture was centrifuged, and the reaction solution was decanted off from residual salts. The solution was added to water to precipitate a white polymer that was filtered, washed with water, then methanol, and then was vacuum dried.

EXAMPLE 9

A polymer with the structure

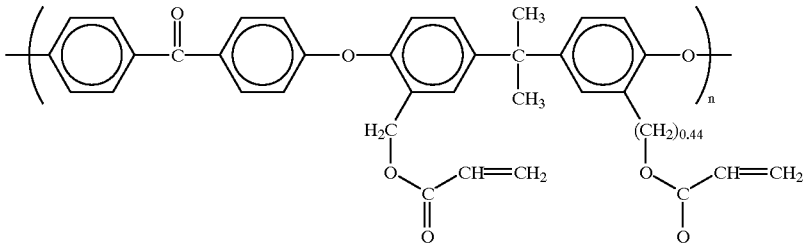

was made as follows. The chloromethylated polymer (1.44 $CH_2Cl$ groups per repeat unit, 15 grams, Example 7) in N,N-dimethylacetamide (283 grams) was magnetically stirred with sodium acrylate (Aldrich Chemical Co., 9 grams) for one month. The reaction mixture was centrifuged, and the reaction solution was decanted off from residual salts. The solution was added to water to precipitate a white polymer that was filtered, washed with water, then methanol, and then was vacuum dried. The polymer in methylene chloride was reprecipitated into methanol, was filtered, and then vacuum dried.

EXAMPLE 10

The polymers prepared in Examples 1, 3, 4, 6, 8, and 9 (2 grams in each instance) were each roll milled in an amber glass bottle with methylene chloride (22.44 grams in each instance) and N,N'-diphenyl-N,N'-bis(3"-methylphenyl)-(1,1'-biphenyl)-4,4'-diamine) (2.00 grams in each instance) (charge transport material, prepared as disclosed in U.S. Pat. No. 4,265,990, the disclosure of which is totally incorporated herein by reference). For comparison purposes, a third transport material was prepared as disclosed except that instead of a polymer of the present invention, 2.00 grams of Makrolon® (polycarbonate resin with a molecular weight of from about 50,000 to about 100,000, obtained from Farbensabricken Bayer A. G.) was used. The resultant solutions were each coated onto the photogenerator layers of imaging members comprising a 3 mil thick metallized polyethylene terephthalate substrate with a vacuum deposited titanium oxide coating about 200 Angstroms thick, a 3-aminopropyltriethoxysilane charge blocking layer 300 Angstroms thick, a polyester adhesive layer (49,000 adhesive obtained from E. I. DuPont deNemours & Co., Wilmington, Del.) about 400 Angstroms thick, and a 0.5 micrometer thick photogenerating layer consisting of with a photogenerating layer containing 40 percent by volume hydroxygallium phthalocyanine and 60 percent by volume of a block copolymer of styrene (82 percent)/4-vinyl pyridine (18 percent) having a Mw of 11,900. This photogenerating coating composition was prepared by dissolving 1.5 grams of the block copolymer of styrene/4-vinyl pyridine in 42 milliliters of toluene. To this solution was added 1.33 grams of hydroxygallium phthalocyanine and 300 grams of ⅛ inch diameter stainless steel shot. This mixture was then placed on a roll mill for 20 hours. The resulting slurry was thereafter applied to the adhesive layer with a Bird applicator to form a layer having a wet thickness of 0.25 mil. This photogenerating layer was dried at 135° C. for 5 minutes in a forced air oven to form a layer having a dry thickness of 0.5 micrometer.

Charge transport layers were then applied to the photogenerating layers thus prepared. Charge transport solutions were prepared in each instance by introducing into an amber glass bottle, 2.00 grams of N,N'-diphenyl-N,N'-bis(3"-methylphenyl)-(1,1'-biphenyl)-4,4'-diamine), 2.00 grams of the same polymer used as the binder in the photogenerating layer (i.e., one with the polymer of Example 1, one with the polymer of Example 3, one with each of the polymers of Examples 6, 8, and 9, respectively, and one with the Makrolon® polycarbonate (Bayer), and 22.44 grams of methylene chloride and admixing the contents to prepare the solution. The charge transport solutions were applied to the photogenerator layers with an 8 mil gap Bird applicator to form a coating which was heated from 40° C. to 100° C. over 30 minutes to dry the layer.

The electrical properties of the imaging members thus prepared were measured with a xerographic testing scanner comprising a cylindrical aluminum drum having a diameter of 242.6 millimeters (9.55 inches) to evaluate photoelectrical integrity. The test samples were taped onto the drum. When rotated, the drum carrying the samples produced a constant surface speed of 76.3 centimeters (30 inches) per second. A direct current pin corotron, exposure light, erase light, and five electrometer probes were mounted around the periphery of the mounted photoreceptor samples. The sample charging time was 33 milliseconds. Both expose and erase lights were broad band white light (400–700 nanometer) outputs, each supplied by a 300 Watt output xenon arc lamp. The relative locations of the probes and lights are indicated in the table below:

| Element Charge | Angle (degrees) 0 | Position (mm) 0 | Distance from Photoreceptor (mm) 18 pins 12 shield |
|---|---|---|---|
| Probe 1 | 22.5 | 47.9 | 3.17 |
| Expose | 56.25 | 118.8 | N.A. |
| Probe 2 | 78.75 | 166.8 | 3.17 |
| Probe 3 | 168.75 | 356.0 | 3.17 |
| Probe 4 | 236.25 | 489.0 | 3.17 |
| Erase | 258.75 | 548.0 | 125.00 |
| Probe 5 | 303.75 | 642.9 | 3.17 |

The test samples were first rested in the dark for at least 60 minutes to ensure achievement of equilibrium with the testing conditions of 21.1° C. and 40.0 percent relative humidity. Each sample was then negatively charged in the dark to a development potential of about 900 volts. The charge acceptance of each sample and its residual potential after discharge by front erase exposure to 400 ergs per square centimeter were recorded. The test procedure was repeated to determine the photoinduced discharge characteristic of each sample (PIDC) by different light energies of up to 20 ergs per square centimeter. Process speed was 60.0 imaging cycles per minute. Some of the residual electrical voltages of the imaging members with charge transport layers containing the polymer binders of the present invention were slightly higher after flood exposure than that of the imaging member with the charge transport layer containing the polycarbonate binder. However, the residual voltages of the imaging members containing the polymers of the present invention gradually decreased during subsequent tests and aging. Results are summarized in the following table. Film peel strength and mechanical properties of the layers containing the polymers of the present invention were good as determined by manual manipulations.

Electrical Properties of Charge Transport Layers Made with Hydroxy-Containing Polymers and N,N'-diphenyl-N,N'-bis(3"-methylphenyl)-(1,1'-biphenyl)4,4'-diamine) on Hydroxygallium Phthalocyanine Photogenerator Layers

| Binder Polymer | S, volts × cm2/ ergs | PIDC Vr, volts | 1 sec Dark Decay, v/sec | Cyclic Characteristics, 10 K Cycle-up | Vo |
|---|---|---|---|---|---|
| Example 1 (THF) | 227 | 108 | 47 | 330 | 799 |
| Example 1 ($CH_2Cl_2$) | 240 | 33 | 109 | 17 | 804 |
| Example 1 (THF) | 233 | 230 | 30 | 41 | 796 |
| Example 1 ($CH_2Cl_2$) | 226 | 79 | 74 | −89 | 799 |
| Example 1 ($CH_2Cl_2$) | 303 | 31 | 80 | −9 | 800 |
| Example 1 ($CH_2Cl_2$) | 213 | 45 | 48 | −39 | 801 |
| Example 1 (THF) | 202 | 83 | 53 | −10 | 804 |
| Example 3 ($CH_2Cl_2$) | 223 | 28 | 89 | −20 | 602 |
| Example 3 (THF) | 129 | 10 | 72 | −9 | 458 |
| Example 3 (THF) | 111 | 9 | 85 | −10 | 423 |
| Example 3 (THF) | 162 | 11 | 96 | −15 | 578 |
| Example 19, TBD/ Makrolon | 359 | 5 | 219 | −22 | 605 |
| Example 3 (THF) overcoat | 377 | 10 | 228 | −9 | 800 |
| Example 3 ($CH_2Cl_2$) | 124 | 120 | 129 | −32 | 650 |
| Example 3 (but with 1.565 Acrylate/Repeat) | 129 | 59 | 108 | 5 | 600 |
| Example 3 (but with 1.565 Acrylate/Repeat) | 162 | 84 | 154 | −0.2 | 600 |
| Example 6 | 302 | 69 | 72 | −13 | 800 |

-continued

| Binder Polymer | S, volts × cm2/ ergs | PIDC Vr, volts | 1 sec Dark Decay, v/sec | Cyclic Characteristics, 10 K Cycle-up | Vo |
|---|---|---|---|---|---|
| Example 8 (but with 0.46 Acrylate/Repeat | 119 | 61 | 160 | 5 | 600 |
| Example 8 but with (0.76 Acrylate/Repeat | 117 | 69 | 155 | 10 | 600 |
| Example 8 with 0.0.96 Acrylate/Repeat | 154 | 118 | 187 | 36 | 600 |
| Example 8 (but with 2.00 Acrylate/Repeat | 84 | 4 | 113 | 2 | 600 |
| Example 9 | 124 | 72 | 120 | −2 | |
| Example 19, TBD/ Makrolon | 363 | 30 | 66 | −2 | 798 |
| Example 19, TBD/ Makrolon | 359 | 5 | 291 | 2 | 801 |
| Example 19, TBD/ Makrolon | 314 | 29 | 63 | 11 | 801 |
| Example 19, TBD/ Makrolon | 357 | 2 | 220 | 2 | 589 |

The initial slope of the discharge curve is termed S in units of (volts×$cm^2$/ergs) and the residual potential after the erase step is termed Vr. The devices were cycled continuously for 10,000 cycles of charge, expose, and erase steps to determine the cyclic stability. Vo is the initial charging potential. Charge trapping in the transport layer results in a build up of residual potential known as cycle-up. The sensitivity data and the residual cycle-up for the four samples is shown in the Table above. S represents the initial slope of the Photo-Induced Discharge Characteristics (PIDC) and is a measure of the sensitivity of the device. Cycle-up is the increase in residual potential in 10,000 cycles of continuous operation. The negative numbers of the residual potential cycle-up resulted from an increase in sensitivity of the pigment in the generator layer as the device was cycled. The numbers indicate that the transport layers of N,N'-diphenyl-N,N'-bis(3"-methylphenyl)-(1,1'-biphenyl)-4,4'-diamine) dispersed in the binders of the present invention were trap free. The absence of traps suggest that the diamine dispersed well in all three of these binders.

The value of S should be about 310 for a 25 micrometer thick polycarbonate film. A value of S divided by 310 multiplied by 25 is expected to approximate the film thickness in micrometers of the various coatings. Many of these coatings are thin which accounts for the lower sensitivity values compared with control samples. The low cycle-up values is support for the cyclic stability of these samples in repeated charge, discharge and erase cycles.

EXAMPLE 11

Binder Generator Layer Preparation

Several photogenerator layers containing hydroxygallium phthalocyanine pigment particles were prepared by forming coatings using conventional coating techniques on a substrate comprising a vacuum deposited titanium layer on a polyethylene terephthalate film (Melinex®, obtained from ICI). The first coating was siloxane barrier layer formed from hydrolyzed gamma-aminopropyltriethoxysilane having a thickness of 0.005 micrometer (50 Angstroms). This film was coated as follows: 3-aminopropyltriethoxysilane (obtained from PCR Research Chemicals, Fla.) was mixed in ethanol in a 1:50 volume ratio. A film of the resulting solution was applied to the substrate in a wet thickness of 0.5 mil using a Bird applicator. The layer was then allowed to dry for 5 minutes at 25° C., followed by curing for 10 minutes at 110° C. in a forced air oven. The second coating was an adhesive layer of polyester resin (49,000 adhesive, obtained from E. I. DuPont deNemours and Co.) having a thickness of 0.005 micron (50 Angstroms) and was coated as follows: 0.5 gram of 49,000 polyester resin was dissolved in 70 grams of tetrahydrofuran and 29.5 grams of cyclohexanone. A film of the resulting solution was coated onto the barrier layer by a 0.5 mil Bird applicator and cured in a forced air oven for 10 minutes. The adhesive interface layer was thereafter coated with a photogenerating layer containing 40 percent by volume hydroxygallium phthalocyanine and 60 percent by volume of a block copolymer of styrene (82 percent)/4-vinyl pyridine (18 percent) having a Mw of 11,900. This photogenerating coating composition was prepared by dissolving 1.5 grams of the block copolymer of styrene/4-vinyl pyridine in 42 milliliters of toluene. To this solution was added 1.33 grams of hydroxygallium phthalocyanine and 300 grams of 1/8 inch diameter stainless steel shot. This mixture was then placed on a roll mill for 20 hours. The resulting slurry was thereafter applied to the adhesive layer with a Bird applicator to form a layer having a wet thickness of 0.25 mil. This photogenerating layer was dried at 135° C. for 5 minutes in a forced air oven to form a layer having a dry thickness of 0.5 micrometer.

EXAMPLE 12

Preparation of a Bisphenol A-Polycarbonate Resin with 0.4 Acryloxy-Methyl Groups per Repeat Unit First, a polymer with the structure

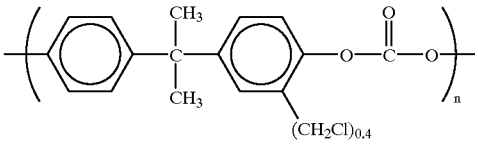

was made as follows. A 5-liter, 3-neck, round-bottom flask was situated in a silicone oil bath and was equipped with a mechanical stirrer, reflux condenser, argon inlet, and stopper. Acetyl chloride (184.75 grams) was then added dropwise to a mixture of dimethoxymethane (225 milliliters, 193 grams) and methanol (6.25 milliliters). To this solution was added 1,1,2,2-tetrachloroethane (500 milliliters) and then tin tetrachloride (0.8 milliliter) in 1,1,2,2-tetrachloroethane (100 milliliters). A solution of polycarbonate (Bayer Makrolon®, 50 grams) in 1,1,2,2-tetrachloroethane (625 milliliters) was then added. The resultant solution was then heated at reflux at 110° C. (oil bath set temperature) for 24 hours. After 4 hours at reflux, an aliquot of the reaction was added to methanol. A $^1$H NMR spectrum of the vacuum dried precipitate was consistent with a bisphenol A-based polycarbonate with 0.14 chloromethyl groups per repeat unit. After 24 hours at 110° C., a polycarbonate with 0.4 chloromethyl groups per repeat unit was obtained. The reaction solution was then added to methanol to precipitate the polymer product that was filtered, washed with methanol, and then vacuum dried with a yield of 51.12 grams.

Next, a polymer with the structure

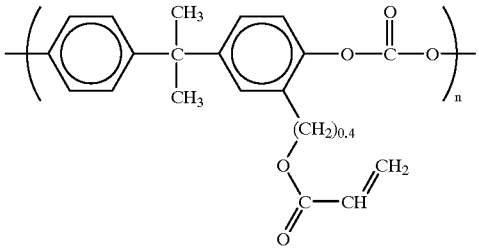

was prepared as follows. The polycarbonate resin with 0.4 chloromethyl groups per repeat unit (25 grams, in N,N-dimethylacetamide (300 milliliters) was magnetically stirred with sodium acrylate (14.3 grams) for 48 days. The reaction mixture was centrifuged and the liquid portion was then added to methanol (6 liters) to precipitate the polymeric product that was isolated by filtration and then vacuum dried. The polymer in methylene chloride (200 grams) was reprecipitated into methanol (4 liters), filtered and vacuum dried to obtain 22 grams of product.

EXAMPLE 13

Preparation of a Bisphenol A-Polycarbonate Resin with 0.1 -Acryloxy-Groups per Repeat Unit A polymer with the structure

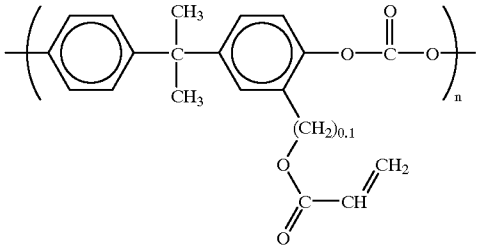

was made as follows. The procedure described in Example 12 was followed except that the reagents were heated at reflux for 5 hours instead of 24 hours. A bisphenol A-polycarbonate was obtained with 0.1 acrylate groups per repeat unit. This polymer (15 grams) with the structure

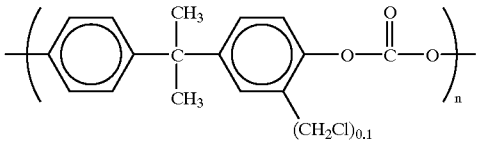

in N,N-dimethylacetamide (300 milliliters) was magnetically stirred for 48 days with sodium acrylate (9 grams, Aldrich chemical Company, Milwaukee, Wisconsin). The reaction mixture was centrifuged and the liquid portion was then added to methanol (4 liters) to precipitate the fully acrylated product that was isolated by filtration and then vacuum dried. The polymer in methylene chloride (66 grams) was reprecipitated into methanol (2 liters), filtered and vacuum dried to obtain 13.7 grams of product.

EXAMPLE 14

A polymer with the structure

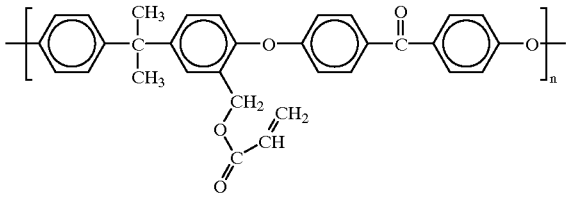

was made as follows. A 5-liter, 3-neck, round-bottom flask was situated in an ice bath and was equipped with a mechanical stirrer, reflux condenser, argon inlet, and stopper. Acetyl chloride (184 grams) was then added dropwise to a mixture of dimethoxymethane (225 milliliters, 193 grams) and methanol (6.25 milliliters). To this solution was added dichloromethane (500 milliliters) with tin tetrachloride (6.5 milliliter) in 1,1,2,2-tetrachloroethane (100 milliliters). A solution of chlorobenzophenone-terminated polyarylene ether ketone (75 grams) in dichloromethane (625 milliliters) was then added. The resultant solution, which immediately became yellow, was then heated at reflux in a silicone oil bath set at 55° C. for 4 hours. The reaction solution was then added to methanol to precipitate the polymer product that was filtered, washed with methanol, and then vacuum dried to obtain 72 grams. The resultant polymer had 0.96 chloromethyl groups per repeat unit. Next, the chloromethylated polymer (15 grams) in N,N-dimethylacetamide (300 milliliters) was magnetically stirred with sodium acrylate (9 grams) for 48 days. The reaction mixture was centrifuged and the liquid portion was then added to methanol (6 liters) to precipitate the polymeric product that was isolated by filtration and then vacuum dried. The polymer in methylene chloride (200 grams) was reprecipitated into methanol (4 liters), filtered and vacuum dried to obtain 14 grams of product.

EXAMPLE 15

A polymer with the structure

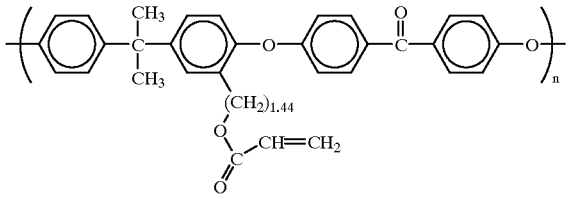

was made as follows in three steps. First, a 5-liter, 3-neck, round-bottom flask equipped with a Barrett trap, condenser, mechanical stirrer, argon inlet, and stopper was situated in a silicone oil bath. 4,4-Difluorobenzophenone (Aldrich, 21.82 grams), bisphenol A (Aldrich, 22.64 grams), potassium carbonate (40 grams), anhydrous N,N-dimethylacetamide (300 milliliters), and toluene (52 milliliters) were added to the flask and heated to 175° C. (oil bath temperature) while the volatile toluene component was collected and removed. After 5 hours of heating at 175° C. with continuous stirring, phenol (5 grams) was added and the reaction mixture was heated and stirred at 175° C. for 30 more minutes. The reaction mixture was allowed to cool to 25° C. The solidified mass was extracted with methylene chloride (500 milliliters) and filtered to remove insoluble salts. The solution was concentrated using a rotary evaporator and then was added to methanol to precipitate the polymer. The polymer was isolated by filtration, washed with water and then methanol, and then was vacuum dried. The yield of polyarylene ether ketone was 40 grams. Second, a 1 -liter, 3-neck round-bottom flask, equipped with a mechanical stirrer, reflux condenser, argon inlet, and stopper, and was situated in a silicone oil bath. Acetyl chloride (140.1 grams, 128 milliliters) was added dropwise to dimethoxymethane (157.6 grams) and methanol (5 milliliters), followed by 1,1,2,2-tetrachloroethane (500 milliliters) and polyarylene ether ketone (40 grams) in tetrachloroethane (500 milliliters). To this was added tin tetrachloride (0.6 milliliter) via an air-tight syringe. The reaction mixture was heated for 2 hours at 110° C. (oil bath set temperature). After cooling to 25° C., the reaction mixture was added to methanol to reprecipitate a polymer with 1.44 chloromethyl groups per repeat unit. The yield of vacuum dried polymer was 45.7 grams. Third, The polymer (25 grams) with 1.44 chloromethyl groups per repeat unit in N,N-dimethylacetamide (300 milliliters) was magnetically stirred with sodium acrylate (15 grams) for 48 days. The reaction mixture was centrifuged, and the liquid portion was then added to methanol (8 liters) to precipitate the polymeric product that was isolated by filtration and then vacuum dried. The polymer in methylene chloride (200 grams) was reprecipitated into methanol (4 liters), filtered and vacuum dried to obtain 22.66 grams of product.

EXAMPLE 16

A polymer with the structure

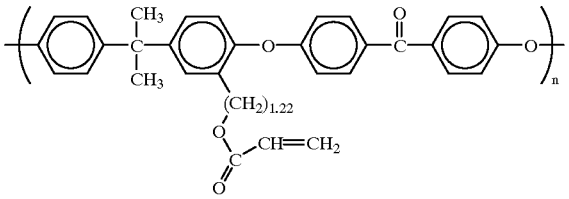

was made as follows. A polyarylene ether ketone with 1.22 chloromethyl groups per repeat unit obtained from Scientific Polymer Products (Ontario, N.Y., 25 grams) in N,N-dimethylacetamide (300 milliliters) was stirred with sodium acrylate (15 grams) for 31 days. The reaction mixture was centrifuged, and the liquid portion was then added to methanol (8 liters) to precipitate the polymeric product that was isolated by filtration and then vacuum dried. The polymer in methylene chloride (200 grams) was reprecipitated into methanol (4 liters), filtered and vacuum dried to obtain 23 grams of product.

EXAMPLE 17

A polymer with the structure

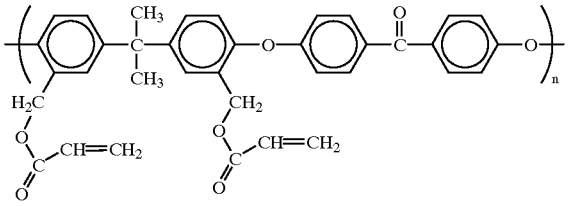

was made as follows. A polyarylene ether ketone with 2 chloromethyl groups per repeat unit obtained from Scientific Polymer Products (Ontario, N.Y., 25 grams) in N,N-dimethylacetamide (300 milliliters) was stirred with sodium acrylate (15 grams) for 31 days. The reaction mixture was centrifuged, and the liquid portion was then added to methanol (8 liters) to precipitate the polymeric product that was isolated by filtration and then vacuum dried. The polymer in methylene chloride (200 grams) was reprecipitated into methanol (4 liters), filtered and vacuum dried to obtain 23 grams of product.

EXAMPLE 18

A polymer with the structure

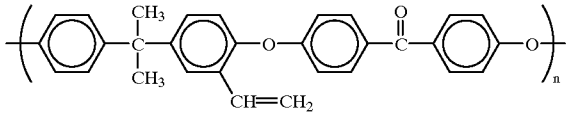

was made as follows. A solution of polyarylene ether ketone with 1.2 chloromethyl group per repeat unit (Scientific Polymer Products, Ontario, N.Y., 7.34 grams, 0.0192 mole) in dioxane (80 grams) was added to triphenylphosphine (12 grams, 0.0458 mole). After 6 hours of reflux at 120° C. (silicone oil bath set temperature) with mechanical stirring and cooling to 25° C., the polymer solidified, and the solvent was decanted off. The solid residue was extracted with diethyl ether (250 milliliters) over 15 minutes. To a solution of the triphenylphosphonium chloride salt of chloromethylated polyarylene ether ketone in methylene chloride (250 milliliters) was added Triton B (5 grams of a 40-wt.% aqueous solution) and formaldehyde (16 milliliters of a 37 wt.% aqueous solution). The stirred reaction mixture is treated slowly with 50-wt.% aqueous sodium hydroxide (50 milliliters). After 7 hours stirring at 25° C., the organic layer was separated, washed with dilute hydrochloric acid, then with water, and then was dried over magnesium sulfate. The methylene chloride layer was added to methanol to precipitate the polymer, which was filtered and vacuum dried. The $^1$H NMR spectrum of the product was consistent with one vinyl group per repeat unit.

EXAMPLE 19

A polymer with the structure

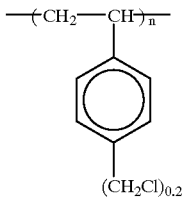

was made as follows. Acetyl chloride (64 milliliters, 71.41 grams) was added dropwise to dimethoxymethane (92 milliliters, 79.16 grams) and methanol (2.6 milliliters) in a 1-liter, 3-neck round-bottom flask equipped with a mechanical stirrer, reflux condenser, argon inlet, and stopper. To this was added methylene chloride (262 milliliters) and tin tetrachloride (0.4 milliliters) in methylene chloride (35 milliliters). Polystyrene (25 grams) in methylene chloride (275 grams) was then added and the reaction was heated in a silicone oil bath at 50° C. for 8 hours. After 4, 6 and 8 hours of reaction at 50° C., there were 0.08, 0.13, and 0.20 chloromethyl groups per repeat unit, respectively. The reaction solution was added to methanol and the polymer that precipitated was filtered, washed with methanol, and vacuum dried.

EXAMPLE 20

A polymer with the structure

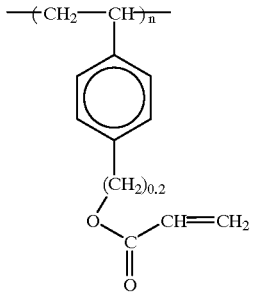

was made as follows. Polystyrene with 0.2 chloromethyl groups per repeat unit (13.4 grams, Example 19) in N,N-dimethylacetamide (300 milliliters) was stirred with sodium acetate (9 grams) for 31 days. The reaction mixture was centrifuged, and the liquid portion was then added to water (8 liters) to precipitate the polymeric product that was isolated by filtration, washed with methanol, and then vacuum dried. The polymer in methylene chloride (100 grams) was reprecipitated into methanol (2 liters), filtered and vacuum dried to obtain 12 grams of product.

EXAMPLE 21

A polymer with the structure

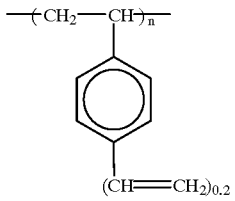

was made as follows. Polystyrene with 0.2-chloromethyl groups per repeat unit (10 grams, 19.2 millimoles, Example 19) in tetrahydrofuran (160 milliliters) was added to triphenylphosphine (12 grams, 46 millimoles) and boiled at reflux for 15 hours. The insoluble polymer was extracted with benzene (800 milliliters). Methylene chloride was added and the solution was added to hexanes to precipitate the polymer that was washed with toluene and then hexanes and then was vacuum dried to yield 13.62 grams of polymer with the structure shown below.

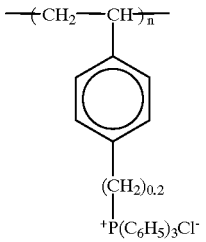

The polymeric phosphonium salt (12.62 grams, 16.16 millimoles) in methanol (230 milliliters) was stirred with Triton B (2.3 grams, 40 wt. % aqueous N-benzyltrimethylammonium hydroxide), formaldehyde (37 wt. % aqueous solution), and 50 wt. % aqueous sodium hydroxide (41.55 milliliters). The reaction mixture was neutralized with acetic acid and washed with water and then methanol. After vacuum drying, 7 grams of product were obtained which was dissolved in methylene chloride, precipitated into methanol, washed with water and then methanol. After vacuum drying, 6 grams of product were obtained.

EXAMPLE 22

Each of the polymers made in Examples 12 through 21 (1.2 grams) were dissolved in methylene chloride (12.4 grams) or tetrahydrofuran (8 grams) with TBD (N,N'-diphenyl-N.N'-bis(3-methylphenyl)-1,1'-biphenyl-4,4'-diamine, 0.8 gram) and were coated on hydroxygallium binder-generator layer using a 4-mil bird bar. The coatings were oven-dried between 40 and 100° C. over 30 minutes. The resultant photoreceptors were electrically scanned, and a summary of the electrical results are summarized in the following table.

TABLE 1

Electrical Properties of Photoreceptors with Crosslinkable Charge Transport Layers

| Sample | Vo | Vdd/sec | S | Vr | V cycle-up |
|---|---|---|---|---|---|
| Example 12 | 798 | 251 | 264 | 117 | 6 |
| Example 13 | 798 | 285 | 309 | 56 | 12 |
| Example 14 | 797 | 267 | 289 | 115 | −5 |
| Example 15 | 798 | 283 | 303 | 81 | −4 |
| Example 16 | 600 | 374 | 154 | 118 | 36 |
| Example 17 | 600 | 113 | 84 | 4 | 2 |
| Example 20 | 800 | 34 | 323 | 367 | −8 |
| Example 20 O/C | 800 | 214 | 460 | 42 | 56 |
| Example 21 O/C | 800 | 211 | 422 | 264 | −23 |
| P.C./TBD | 800 | 303 | 319 | 2 | −2 |
| P.C./TBD+ | 799 | 307 | 325 | 37 | 9.1 |
| P.C./TBD O/C | 801 | 232 | 462 | 1 | 2 |

Samples designated O/C refer to standard production photoreceptors that were overcoated with the various crosslinkable charge transport layers. The coating solution was applied with a 2 mil gap Bird applicator. The Examples A, B, C, D, and P.C./TBD+ each contain 0.01 grams of azobisisobutylronitrile (AIBN). Addition of benzoyl peroxide to the coating formulations results in instantaneous oxidation of the TBD charge transport molecule and thus was avoided. A number of conclusions were made. Residual voltage (Vr) increases with increased crosslinking functionality while photoreceptor sensitivity decreases. Acrylate groups are better than styryl (vinyl-phenyl) groups, whereas unconjugated vinyl bonds have little effect on photoreceptor electricals. Polycarbonates appear superior to polyarylene ether ketones which in turn are better than polystyrene; however, this result reflects the trend of decreased electrical performance with increasing functionality and cross link density.

The reaction schemes described are summarized below.

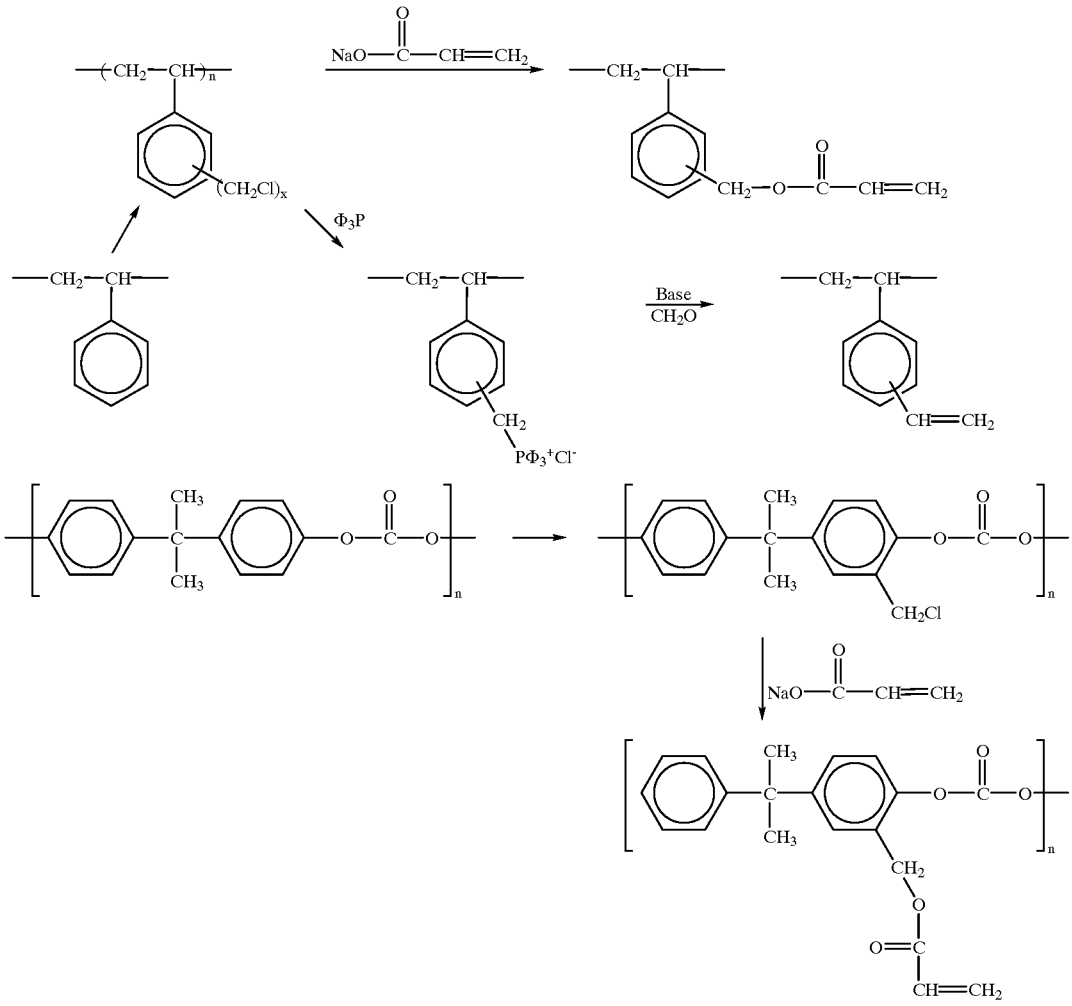

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a support member, charge generating layer and a charge transport layer, the charge transport layer comprising a cross linked matrix obtained from a cross linkable aromatic polymer with substituent groups containing unsaturated carbon to carbon double bonds, the substituent being attached to phenylene groups by chemical bonds, and a coreactive monomer, and a charge transport molecule dissolved or molecularly dispersed in the cross linked matrix derived from the cross linkable aromatic polymer.

2. An electrophotographic imaging member according to claim 1 wherein the cross linkable aromatic polymer comprises from about 1 percent to about 99 percent by weight of the crosslinked polymer with the remainder being the reactive comonomer, based on the total weight of the crosslinked polymer.

3. An electrophotographic imaging member comprising a support member, a charge generating layer and a charge transport layer, the charge transport layer comprising a cross linked matrix obtained from a cross linkable aromatic polymer with substituent groups containing unsaturated carbon to carbon double bond, the substituent groups being free of urethane linkage and attached to phenylene groups by chemical bonds other than urethane linkages wherein the charge transport layer comprises a charge transport molecule dissolved or molecularly dispersed in the cross linked matrix derived from the cross linkable aromatic polymer.

4. An electrophotographic imaging member according to claim 3 wherein the cross linkable aromatic polymer comprises segments represented by formulae selected from the group consisting of

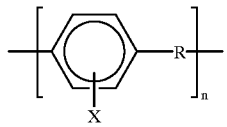

wherein n is an integer representing the number of repeating monomer units,

R is a divalent group, and

X is a substituent group free of any urethane linkage and containing an unsaturated carbon to carbon double bond attached to the aromatic group by other than urethane linkages and

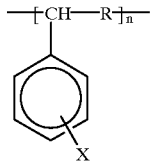

wherein n is an integer representing the number of repeating monomer units,

R is a divalent group, and

X is a substituent group free of any urethane linkage and containing an unsaturated carbon to carbon double bond attached to the aromatic group by other than urethane linkages.

5. An electrophotographic imaging member according to claim 4 wherein the segments are represented by a formula selected from the group consisting of

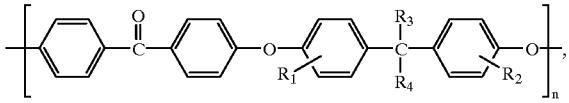

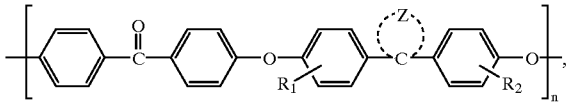

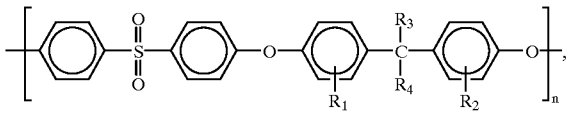

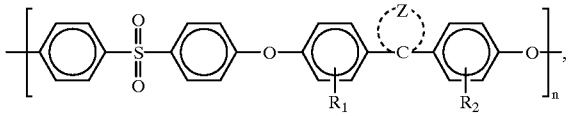

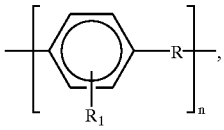

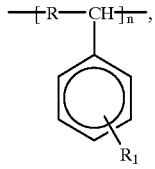

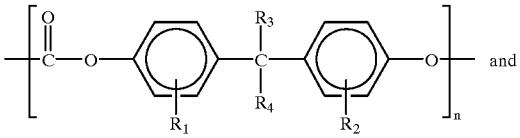

and

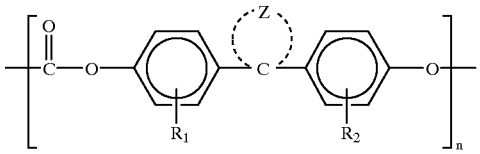

wherein each of:

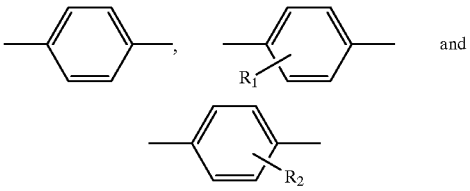

in the above formulae is independently substituted or unsubstituted other than with $R_1$ and $R_2$, n is an integer representing the number of repeating monomer units, $R_1$ and $R_2$ are independently selected from the group comprising —H and —$CH_2$—$R_5$, wherein at least one of $R_1$ and $R_2$ is —$CH_2$—$R_5$, $R_3$ and $R_4$ are independently selected from the group comprising H, substituted organic groups, and unsubstituted organic groups, the organic groups containing from 1 to 20 carbon atoms, $R_5$ is a radical free from any urethane linkage and derived from a monobasic or polybasic organic acid containing a reactive unsaturated carbon to carbon double bond without urethane linkages, Z is a group of atoms necessary to constitute a cycloaliphatic or heterocyclic ring containing from 3 to 20 carbon atoms, and R is a divalent group.

6. An electrophotographic imaging member according to claim 5 wherein $R_3$ and $R_4$ are monovalent groups independently selected from the group comprising H, $CH_3$, $CF_3$, ethyl, phenyl, substituted aliphatic, allyl, cyclohexyl and fluorenenyl.

7. An electrophotographic imaging member according to claim 5 wherein $R_5$ is a radical derived from a monobasic or polybasic organic acid containing a reactive carbon to carbon double bond.

8. An electrophotographic imaging member according to claim 5 wherein Z is a cyclohexyl group.

9. An electrophotographic imaging member according to claim 4 wherein the value for n is such that the weight average molecular weight of the polymer prior to cross linking is from about 1,000 to about 300,000.

10. An electrophotographic imaging member according to claim 4 wherein the polymer prior to cross linking has a glass transition temperature of from about 50° C. to about 350° C.

11. An electrophotographic imaging member according to claim 4 wherein X is a reactive alkenyl or olefinic group capable of addition polymerization.

12. An electrophotographic imaging member according to claim 4 wherein X is an unsaturated acidoxymethylene group.

13. An electrophotographic imaging member according to claim 4 wherein the cross linkable aromatic polymer is a copolymer.

14. An electrophotographic imaging member according to claim 13 wherein the charge transport molecule has the formula

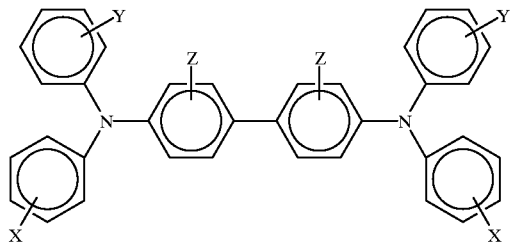

wherein X, Y and Z are each, independently selected from hydrogen, halogen, alkyl groups having from 1 to about 20 carbon atoms and chlorine, and at least one of X, Y and Z is independently selected from the group consisting of an alkyl group having from 1 to about 20 carbon atoms and chlorine.

15. An electrophotographic imaging member according to claim 13 wherein the charge transport layer comprises from about 5 to about 90 percent by weight of the charge transport molecule, based on the total weight of the dried charge transport layer.

16. An electrophotographic imaging member according to claim 3 wherein the cross linkable aromatic polymer is an acidoxymethylated polyarylene ether ketone.

17. An electrophotographic imaging member according to claim 3 wherein the cross linkable aromatic polymer is a vinyl substituted polyarylene ether ketone.

18. An electrophotographic imaging member comprising a support member, a charge generating layer and a charge transport layer, the charge transport layer comprising a cross linked matrix obtained from a cross linkable aromatic polymer with substituent groups containing unsaturated carbon to carbon double bond, the substituent groups being free of urethane linkage and attached to phenylene groups by chemical bonds other than urethane linkages wherein the cross linkable aromatic polymer is an acrylated polycarbonate.

* * * * *